US010236614B2

(12) United States Patent
Sugiyama et al.

(10) Patent No.: US 10,236,614 B2
(45) Date of Patent: Mar. 19, 2019

(54) CONNECTION DEVICE AND RELAY CONNECTOR

(71) Applicant: Yazaki Corporation, Tokyo (JP)

(72) Inventors: Fuminori Sugiyama, Shizuoka (JP); Shigeo Mori, Shizuoka (JP); Takashi Sone, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/823,423

(22) Filed: Nov. 27, 2017

(65) Prior Publication Data

US 2018/0175534 A1 Jun. 21, 2018

(30) Foreign Application Priority Data

Dec. 20, 2016 (JP) ..... 2016-247071

(51) Int. Cl.
*H01R 13/24* (2006.01)
*H01R 13/52* (2006.01)
(Continued)

(52) U.S. Cl.
CPC ..... *H01R 13/2464* (2013.01); *F02P 15/00* (2013.01); *H01R 13/2492* (2013.01);
(Continued)

(58) Field of Classification Search
CPC .... H01R 13/24; H01R 13/22; H01R 13/2464; H01R 13/521; H01R 13/629;
(Continued)

(56) References Cited

U.S. PATENT DOCUMENTS 4,161,346 A * 7/1979 Cherian ..... H01R 12/714 439/515
5,139,427 A * 8/1992 Boyd ..... H01R 12/52 439/247
(Continued)

FOREIGN PATENT DOCUMENTS

JP 4-112482 U 9/1992
JP 2002-313459 A 10/2002
(Continued)

OTHER PUBLICATIONS

Japanese Office Action for the related Japanese Patent Application No. 2016-247071 dated Nov. 20, 2018.

*Primary Examiner* — Harshad C Patel
(74) *Attorney, Agent, or Firm* — Kenealy Vaidya LLP

(57) ABSTRACT

A connection device to which a relay connector is applied includes relay terminals that have first connection portions capable of being elastically deformed along a first direction, second connection portions capable of being elastically deformed along the first direction, and coupling portions connecting the first and second connection portions, and are formed integrally with the first and second connection portions, and the coupling portions, and a holding unit that holds the relay terminal and has reaction force receiving portions supporting the coupling portions with such positional relation that first counterpart terminals are capable of being connected to the first connection portions from one side in the first direction and second counterpart terminals are capable of being connected to the second connection portions from the other side in the first direction and receiving reaction forces with elastic deformation of the first and second connection portions.

20 Claims, 12 Drawing Sheets

(51) Int. Cl.

| | |
|---|---|
| ***H01R 13/629*** | (2006.01) |
| ***H01R 13/639*** | (2006.01) |
| ***H01R 13/719*** | (2011.01) |
| ***H01R 13/422*** | (2006.01) |
| ***F02P 15/00*** | (2006.01) |

(52) U.S. Cl.
CPC ..... *H01R 13/422* (2013.01); *H01R 13/521* (2013.01); *H01R 13/629* (2013.01); *H01R 13/639* (2013.01); *H01R 13/719* (2013.01); *H01R 13/2435* (2013.01); *H01R 13/5202* (2013.01); *H01R 2201/26* (2013.01)

(58) Field of Classification Search
CPC ..... H01R 13/639; H01R 13/719; H01R 2201/26; H01H 45/02; H01H 50/02; H01H 63/00
USPC ..... 439/700, 824, 816, 607.17, 667, 850, 439/856, 595, 867, 591
See application file for complete search history.

(56) References Cited

U.S. PATENT DOCUMENTS

| | | | | |
|---|---|---|---|---|
| 5,498,166 | A * | 3/1996 | Rothenberger .... | H01R 13/5202 439/66 |
| 6,193,524 | B1 * | 2/2001 | Chang ..... | H01R 13/2428 439/66 |
| 6,241,531 | B1 * | 6/2001 | Roath ..... | H01R 12/52 439/591 |
| 7,094,066 | B2 * | 8/2006 | Mendenhall ..... | H01R 13/2435 439/66 |
| 7,621,755 | B2 * | 11/2009 | Kubo ..... | H01R 13/2435 439/66 |
| 7,625,216 | B2 * | 12/2009 | Mendenhall ..... | H01R 13/2435 439/66 |
| 8,672,688 | B2 * | 3/2014 | Florence, Jr. ..... | H01R 12/52 439/66 |
| 2013/0012069 | A1 | 1/2013 | Liu et al. | |
| 2013/0045633 | A1 * | 2/2013 | Murakami ..... | H01R 13/447 439/626 |
| 2014/0117783 | A1 * | 5/2014 | Rassoolkhani ..... | H01R 13/62 307/141.4 |
| 2014/0162502 | A1 * | 6/2014 | Geiler ..... | H01R 13/2421 439/700 |

FOREIGN PATENT DOCUMENTS

| | | | |
|---|---|---|---|
| JP | 2003-163045 | A | 6/2003 |
| JP | 5012399 | B2 | 8/2012 |
| JP | 2016-110848 | A | 6/2016 |

* cited by examiner

CONNECTION DEVICE AND RELAY CONNECTOR

CROSS-REFERENCE TO RELATED APPLICATION(S)

The present application claims priority to and incorporates by reference the entire contents of Japanese Patent Application No. 2016-247071 filed in Japan on Dec. 20, 2016.

BACKGROUND OF THE INVENTION

1. Field of the Invention

The present invention relates to a connection device and a relay connector.

2. Description of the Related Art

As a conventional connection device that is applied to vehicles and the like, for example, Japanese Patent No. 5012399 discloses a high-voltage cable connection device for vehicle driving power that includes a male connector and a female connector. The male connector includes an insulating cylindrical portion and a first terminal that is provided on a bottom portion of the cylindrical portion and to which a first cable is connected. The female connector includes a hole having an opening an inner dimension of which is larger than an outer dimension of the cylindrical portion of the male connector and a second terminal that is provided on a bottom portion of the hole and to which a second cable is connected. The connection device includes a conductive spring having a structure that is fixed to neither of the first terminal nor the second terminal and is inserted into the cylindrical portion. The conductive spring abuts against the first terminal and the second terminal and is compressed when the cylindrical portion of the male connector is fitted into the hole of the female connector for connecting the connectors, and electrically connects the terminals.

The above-mentioned high-voltage cable connection device for vehicle driving power that is disclosed in Japanese Patent No. 5012399 has further room for improvement in, for example, stability of a contact point between the terminals.

SUMMARY OF THE INVENTION

The present invention has been made in view of the above-mentioned circumstances and an object thereof is to provide a connection device and a relay connector that can stabilize a contact point.

In order to achieve the above mentioned object, a connection device according to one aspect of the present invention includes a conductive first counterpart terminal; a conductive second counterpart terminal that is different from the first counterpart terminal; a conductive relay terminal that includes a first connection portion capable of being elastically deformed along a first direction, a second connection portion capable of being elastically deformed along the first direction, and a coupling portion interposed between the first connection portion and the second connection portion along the first direction and connecting the first connection portion and the second connection portion, and that is formed integrally with the first connection portion, the second connection portion, and the coupling portion; and a holding unit that holds the relay terminal and includes a reaction force receiving portion supporting the coupling portion with such positional relation that the first counterpart terminal is capable of being connected to the first connection portion from one side in the first direction and the second counterpart terminal is capable of being connected to the second connection portion from another side in the first direction, and receiving reaction force with elastic deformation of the first connection portion and reaction force with elastic deformation of the second connection portion.

According to another aspect of the present invention, in the connection device, it is possible to configure that the first connection portion has a first base end portion continuous to the coupling portion, a first elastic bending portion formed so as to be continuous to the first base end portion at one side in the first direction while being bent and capable of abutting against the first counterpart terminal, and a first front end portion continuous to the first elastic bending portion at an opposite side to the first base end portion and supporting the first elastic bending portion on the coupling portion, and the second connection portion has a second base end portion continuous to the coupling portion, a second elastic bending portion formed so as to be continuous to the second base end portion at another side in the first direction while being bent and capable of abutting against the second counterpart terminal, and a second front end portion continuous to the second elastic bending portion at an opposite side to the second base end portion and supporting the second elastic bending portion on the coupling portion.

According to still another aspect of the present invention, in the connection device, it is possible to configure that the coupling portion has a first base portion to which the first connection portion is connected, a second base portion that opposes the first base portion with the reaction force receiving portion interposed therebetween in the first direction and to which the second connection portion is connected, and a connecting portion that connects the first base portion and the second base portion along the first direction.

According to still another aspect of the present invention, in the connection device, it is possible to further include a relay housing that includes an accommodation space portion that accommodates, in an inner portion formed into a hollow shape, the holding unit holding the relay terminal so as to make the holding unit relatively movable in the first direction, a first insertion hole that is opened to one side in the first direction and communicates with the accommodation space portion and through which the first counterpart terminal is capable of being inserted along the first direction, and a second insertion hole that is opened to another side in the first direction and communicates with the accommodation space portion and through which the second counterpart terminal is capable of being inserted along the first direction.

According to still another aspect of the present invention, in the connection device, it is possible to configure that the relay terminal has a slit formed across the first connection portion, the coupling portion, and the second connection portion.

According to still another aspect of the present invention, in the connection device, it is possible to configure that the first counterpart terminal has a first connection surface that is planarly formed along an intersection direction intersecting with the first direction and abuts against the first connection portion, and the second counterpart terminal has a second connection surface that is planarly formed along the intersection direction and abuts against the second connection portion.

According to still another aspect of the present invention, in the connection device, it is possible to configure that the first counterpart terminal configures a first connector provided in a first device, and the second counterpart terminal configures a second connector provided in a second device that is different from the first device.

In order to achieve the above mentioned object, a relay connector according to still another aspect of the present invention includes a conductive relay terminal that includes a first connection portion capable of being elastically deformed along a first direction, a second connection portion capable of being elastically deformed along the first direction, and a coupling portion interposed between the first connection portion and the second connection portion along the first direction and connecting the first connection portion and the second connection portion, and that is formed integrally with the first connection portion, the second connection portion, and the coupling portion; and a holding unit that holds the relay terminal and includes a reaction force receiving portion supporting the coupling portion with such positional relation that a conductive first counterpart terminal is capable of being connected to the first connection portion from one side in the first direction and a conductive second counterpart terminal different from the first counterpart terminal is capable of being connected to the second connection portion from another side in the first direction, and receiving reaction force with elastic deformation of the first connection portion and reaction force with elastic deformation of the second connection portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment according to the present invention will be described in detail with reference to the drawings. It should be noted that the embodiment does not limit the invention. Components in the following embodiment include components that can be replaced by those skilled in the art or that are substantially the same. In the respective drawings, a first device and a second device are illustrated while only parts thereof are omitted.

Embodiment

Figure 1:
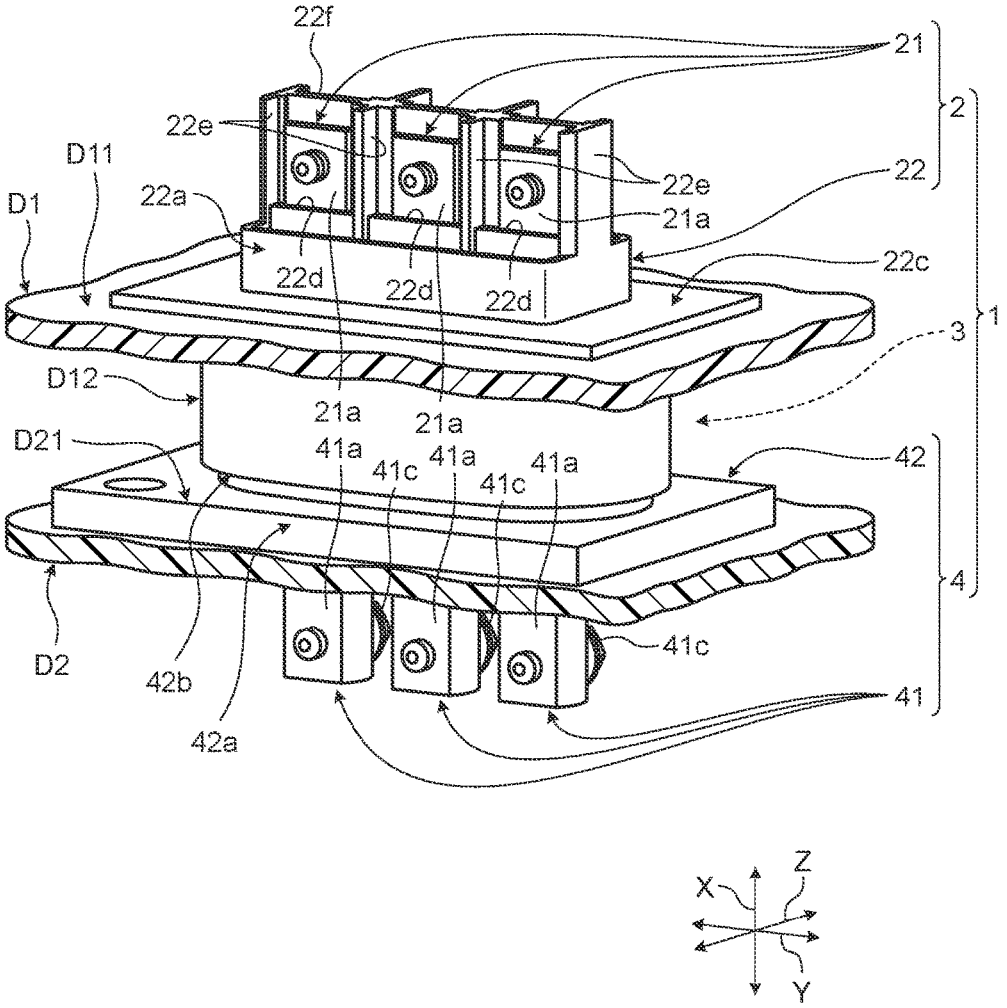
FIG. 1 is a partial perspective view illustrating the schematic configuration of a connection device according to an embodiment.
Figure 2:
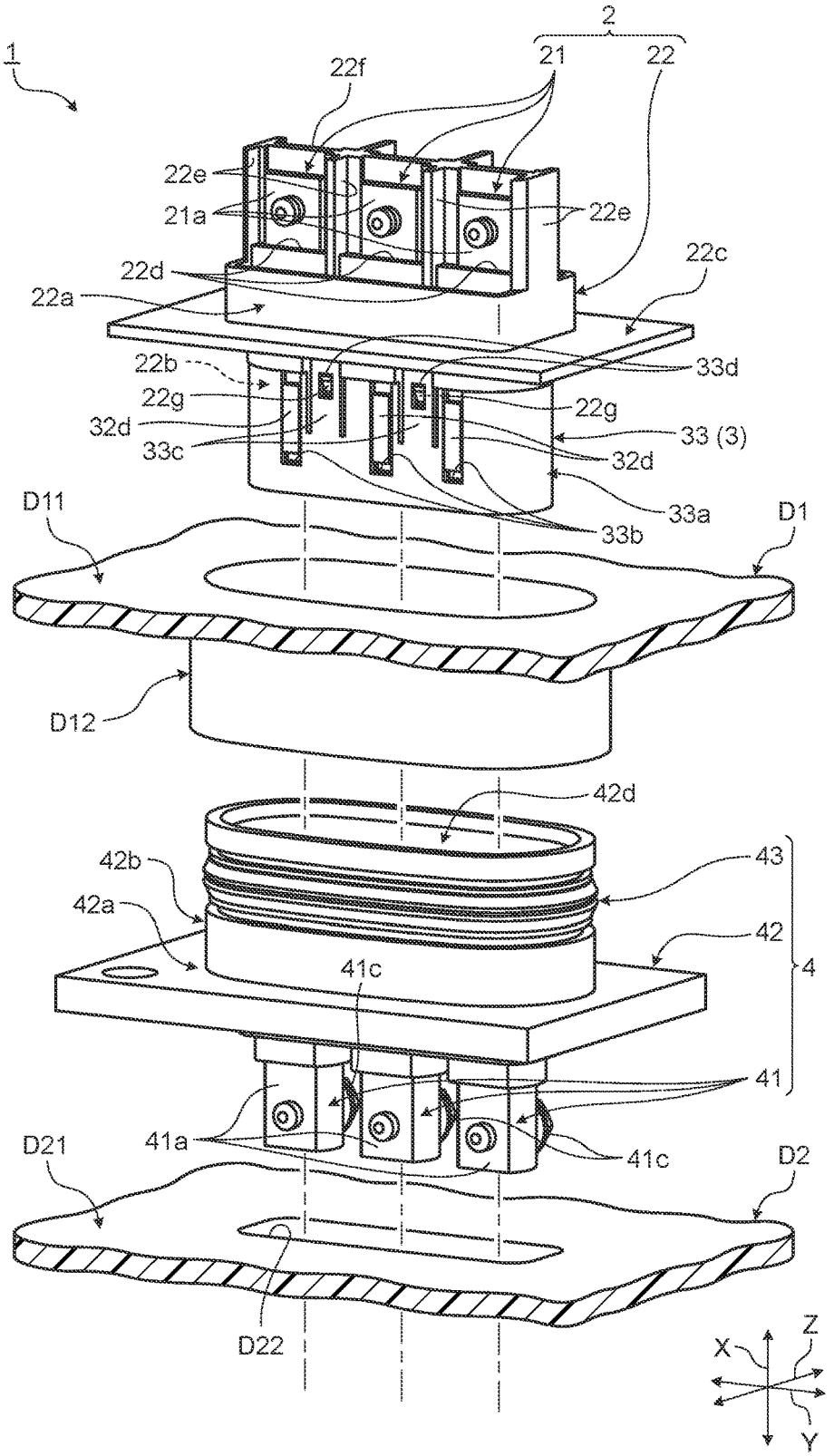
FIG. 2 is a partial exploded perspective view illustrating the schematic configuration of the connection device in the embodiment.
Figure 3:
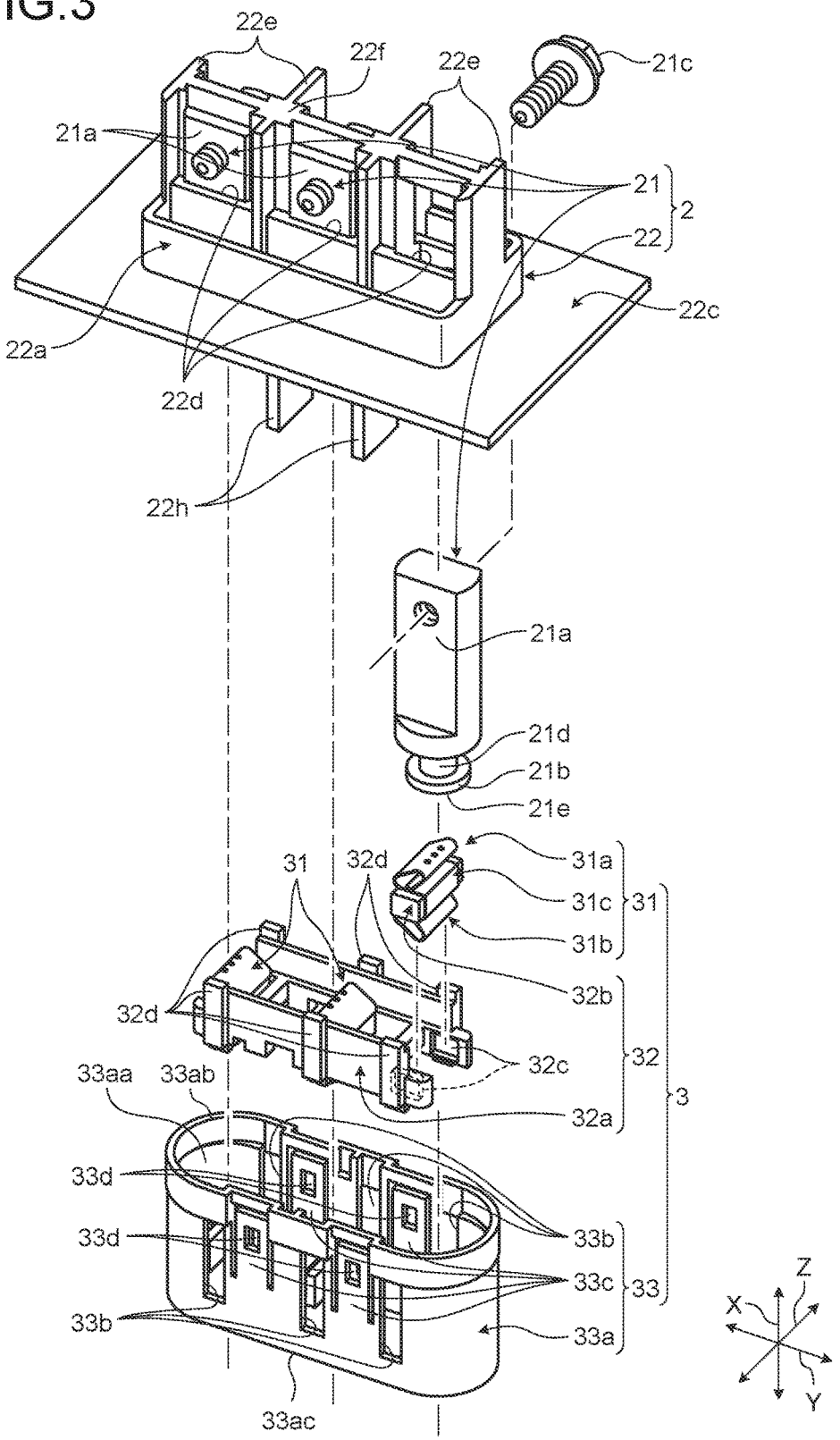
FIG. 3 is an exploded perspective view illustrating the schematic configurations of a first connector and a relay connector included in the connection device in the embodiment.
Figure 4:
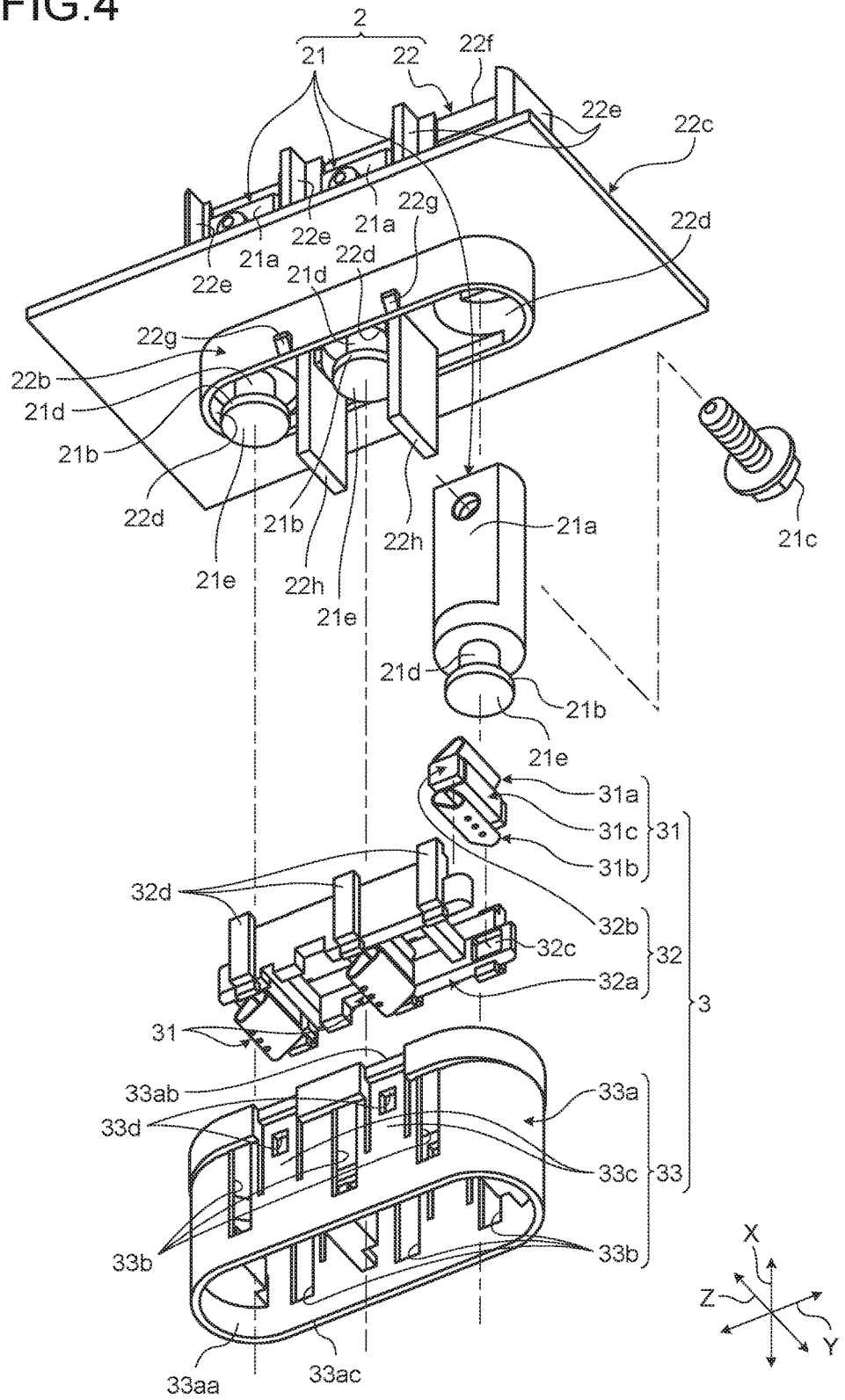
FIG. 4 is an exploded perspective view illustrating the schematic configurations of the first connector and the relay connector included in the connection device in the embodiment.

A connection device 1 according to the embodiment illustrated in FIG. 1 and FIG. 2 includes a first connector 2, a relay connector 3, and a second connector 4 and stabilizes contact points between terminals by electrically connecting the first connector 2 and the second connector 4 through the relay connector 3. In the connection device 1 in the embodiment, the first connector 2 is provided in a first device D1 and the second connector 4 is provided in a second device D2 that is different from the first device D1. In the connection device 1, the first connector 2 and the second connector 4 are fitted with each other with the relay connector 3 interposed therebetween to form electric connection sites therebetween. The connection device 1 in the embodiment thereby configures a device-to-device connection device that enables supply of a power source and signal communication between the first device D1 and the second device D2 by electrically connecting the first device D1 and the second device D2 through the first connector 2, the relay connector 3, and the second connector 4.

The first device D1 and the second device D2 to which the connection device 1 in the embodiment is applied are mounted on, for example, vehicles. As an example, the first device D1 is an inverter that is mounted on vehicles such as hybrid cars and electric cars and the second device D2 is a motor that is mounted on the vehicles. The first device D1 as the inverter is a conversion device that converts direct current (DC) output from a power source mounted on the vehicle to three-phase alternating current (AC) output. The second device D2 as the motor is a device that is driven with the three-phase AC power output from the first device D1 as the inverter and generates driving force for traveling of the vehicle, and is, for example, a Y-connected three-phase motor. The first connector 2 configures an inverter direct-mounted connector (INV connector) that is directly mounted on the first device D1 as the inverter and the second connector 4 configures a motor direct-mounted connector (MOT connector) that is directly mounted on the second device D2 as the motor. The first device D1 includes a fitting hood portion D12 that is formed on a casing D11 and communicates the inside and the outside of the casing D11, and the first connector 2 and the relay connector 3 are provided in the fitting hood portion D12. The fitting hood portion D12 is formed into a substantially long cylindrical shape and one end portion thereof is opened to the inside of the casing and the other end portion thereof is opened to the outside of the casing. The fitting hood portion D12 accommodates therein a part of the first connector 2 and the relay connector 3, and the second connector 4 provided in the second device D2 is fitted with the fitting hood portion D12. The second device D2 includes a communication hole portion D22 that is formed in a casing D21 and communicates the inside and the outside of the casing D21, and the second connector 4 is provided in the communication hole portion D22. The communication hole portion D22 is formed as a through-hole having a substantially oblong shape with rounded corners. A part of the second connector 4, in this example, second counterpart terminals 41 are inserted through the communication hole portion D22. The connection device 1 enables the first device D1 and the second device D2 to mutually transfer relatively high-voltage three-phase AC power through first counterpart terminals 21 of the first connector 2, relay terminals 31 of the relay connector 3, and the second counterpart terminals 41 of the second connector 4. Hereinafter, the respective configurations of the connection device 1 will be described in detail with reference to the respective drawings.

In the following description, a first direction is referred to as an "axial direction X", a second direction is referred to as a "first width direction Y", and a third direction is referred to as a "second width direction Z". The first direction, the second direction, and the third direction intersect with one another. The axial direction X, the first width direction Y, and the second width direction Z are orthogonal to one another. The axial direction X typically corresponds to a direction along an extension direction of the first counterpart terminals 21 and the second counterpart terminals 41, which will be described later, and more specifically, corresponds to a direction along a fitting direction of the first connector 2 and the second connector 4. The first width direction Y and the second width direction Z correspond to intersection directions that intersect with the axial direction X. The respective directions that are used in the following description indicate directions in a state in which the respective parts of the connection device 1 are assembled on one another unless otherwise specified.

To be specific, the first connector 2 includes the first counterpart terminals 21 and a first housing 22, as illustrated in FIG. 1, FIG. 2, FIG. 3, and FIG. 4, and the first counterpart terminals 21 are provided in the first housing 22 along the axial direction X.

The first counterpart terminals 21 are metal fittings formed into columnar shapes with a conductive metal material and configure the first connector 2 that is provided on the first device D1. The first counterpart terminals 21 are formed into the columnar shapes about center axis lines along the axial direction X and are formed so as to extend along the axial direction X. In this example, the first counterpart terminals 21 are formed into substantially cylindrical shapes parts of which are planarly chamfered. The first counterpart terminals 21 include connection end portions 21*a* formed at one side in the axial direction X and connection end portions 21*b* formed at the other side in the axial direction X. The connection end portions 21*a* are formed by planarly chamfering parts of the substantially cylindrical shapes and components of the first device D1 as the inverter are electrically connected thereto. The first counterpart terminals 21 are assembled into terminal insertion holes 22*d* of the first housing 22, which will be described later, and then, the components of the first device D1 are electrically connected to the connection end portions 21*a* through fastening bolts 21*c* and the like. The connection end portions 21*b* are formed into substantially cylindrical shapes about the center axis lines along the axial direction X. The connection end portions 21*b* are connected to the connection end portions 21*a* through small diameter portions 21*d* having smaller diameters than the connection end portions 21*b*. The first counterpart terminals 21 have first connection surfaces 21*e* that are formed planarly along the first width direction Y and the second width direction Z as the intersection directions orthogonal to (intersecting with) the axial direction X and abut against the relay terminals 31 of the relay connector 3, which will be described later. The first connection surfaces 21*e* are configured by the surfaces of the connection end portions 21*b* that face the relay terminals 31 in the axial direction X, in this example, by the end surfaces thereof at the opposite side to the connection end portions 21*a*. First connection portions 31*a* of the relay terminals 31 abut against the first connection surfaces 21*e* of the connection end portions 21*b* of the first counterpart terminals 21. With this configuration, contact points as electric connection sites are formed between the first counterpart terminals 21 and the relay terminals 31, which will be described later. The first counterpart terminals 21 configured as described above for three phases corresponding to the three-phase AC power, that is, the three first counterpart terminals 21 are provided.

The first housing 22 is provided with the first counterpart terminals 21 along the axial direction X and accommodates and holds therein the first counterpart terminals 21. The first housing 22 is made of an insulating resin material. The first housing 22 includes a main body portion 22*a*, a mounting portion 22*b*, a flange portion 22*c*, and the terminal insertion holes 22*d*, and the whole is integrally formed.

The main body portion 22*a* and the mounting portion 22*b* hold the first counterpart terminals 21 along the axial direction X and are formed in an adjacent manner in the axial direction X such that the main body portion 22*a* is located at one side in the axial direction X and the mounting portion 22*b* is located at the other side in the axial direction X. The main body portion 22*a* is formed into a substantially rectangular parallelepiped shape and the mounting portion 22*b* is formed into a substantially long cylindrical shape that is smaller than the fitting hood portion D12. The flange portion 22*c* is formed in a boundary portion between the main body portion 22*a* and the mounting portion 22*b* in the axial direction X. The flange portion 22*c* is formed so as to project from the boundary portion between the main body portion 22*a* and the mounting portion 22*b* along the first width direction Y and the second width direction Z. The flange portion 22*c* is formed into a substantially rectangular plate shape such that the plate thickness direction is the axial direction X.

The terminal insertion holes 22*d* are formed in the main body portion 22*a* and the mounting portion 22*b* along the axial direction X. The terminal insertion holes 22*d* are formed into hollow shapes so as to penetrate through the main body portion 22*a* and the mounting portion 22*b* along the axial direction X. The terminal insertion holes 22*d* are space portions into which the first counterpart terminals 21 can be inserted along the axial direction X and that hold therein the first counterpart terminals 21. The terminal insertion holes 22*d* are formed so as to extend along the axial direction X and are also referred to as cavities. The connection end portions 21*a* of the first counterpart terminals 21 are inserted into the terminal insertion holes 22*d* from, for example, the mounting portion 22*b* side and the terminal insertion holes 22*d* hold therein the first counterpart terminals 21 with such positional relation that the center axis lines thereof are along the axial direction X. Alternatively, the first housing 22 may be formed by insertion molding or the like such that the first counterpart terminals 21 are held at positions corresponding to the terminal insertion holes 22*d*. The three terminal insertion holes 22*d* are provided to be aligned along the first width direction Y so as to correspond to the three first counterpart terminals 21.

The main body portion 22*a* includes support plate portions 22*e* and a beam-like portion 22*f* supported by the support plate portions 22*e*. The support plate portions 22*e* are formed into substantially rectangular plate shapes such that the support plate portions 22*e* project to one side in the axial direction X and the plate thickness directions are the first width direction Y. The four support plate portions 22*e* in total are provided in such a manner that the one support plate portion 22*e* is provided at each of both end portions of the main body portion 22*a* in the first width direction Y and the one support plate portion 22*e* is provided at each place between the three terminal insertion holes 22*d*. The beam-like portion 22*f* is formed so as to extend along the first width direction Y and is supported by the support plate portions 22*e*. The beam-like portion 22*f* is positioned by abutting against the connection end portions 21*a* of the first counterpart terminals 21 that are exposed from the terminal insertion holes 22*d* at one side in the axial direction X in a state in which the first counterpart terminals 21 are held in the terminal insertion holes 22*d*.

The mounting portion 22*b* includes locking claw portions 22*g* and partition plates 22*h*. In this example, the four locking claw portions 22*g* are formed on the outer surface of the mounting portion 22*b* in a projecting manner and lock the relay connector 3. The mounting portion 22*b* thus configures a portion on which the relay connector 3 is mounted. The partition plates 22*h* are formed into substantially rectangular plate shapes that project to the other side in the axial direction X such that the plate thickness directions are the first width direction Y. The two partition plates 22*h* in total are provided in such a manner that one partition plate 22*h* is provided at each place between the three terminal insertion holes 22*d*.

The relay connector 3 includes the relay terminals 31, a holding unit 32, and a relay housing 33, as illustrated in FIG. 2, FIG. 3, FIG. 4, FIG. 5 FIG. 6, and FIG. 7, and the relay terminals 31 are provided in the holding unit 32 assembled on the relay housing 33. The relay connector 3 relays electric connection between the first connector 2 and the second connector 4 through the relay terminals 31. The three relay terminals 31 are provided so as to correspond to the three first counterpart terminals 21. The relay connector 3 is assembled on the first connector 2 for description.

The relay terminals 31 are metal fittings formed into columnar shapes with a conductive metal material. The relay terminals 31 have first connection portions 31*a*, second connection portions 31*b*, and coupling portions 31*c*, and the first connection portions 31*a*, the second connection portions 31*b*, and the coupling portions 31*c* are integrally formed. The first connection portions 31*a* can be elastically deformed along the axial direction X and abut against and are electrically connected to the first counterpart terminals 21. The second connection portions 31*b* can be elastically deformed along the axial direction X and abut against and are electrically connected to the second counterpart terminals 41. The coupling portions 31*c* are interposed between the first connection portions 31*a* and the second connection portions 31*b* along the axial direction X and connect the first connection portions 31*a* and the second connection portions 31*b*. The relay terminals 31 have the configuration in which the first connection portions 31*a* are located at one side and the second connection portions 31*b* are located at the other side with the coupling portions 31*c* interposed therebetween in the axial direction X. In this example, the relay terminals 31 are formed such that the first connection portions 31*a* and the second connection portions 31*b* have substantially equivalent shapes and have line symmetric shapes along the axial direction X with respect to center positions in the axial direction X. The first connection portions 31*a* of the relay terminals 31 are located at the first connector 2 side and the second connection portions 31*b* thereof are located at the opposite side (side at which the second connector 4, which will be described later, is located) to the first connector 2 side in the axial direction X in a state in which the relay connector 3 is assembled on the first connector 2. In other words, in the state in which the relay connector 3 is assembled on the first connector 2, portions of the first connection portions 31*a* and the second connection portions 31*b* that are located at the first connector 2 side in the axial direction X correspond to the first connection portions 31*a* and portions thereof that are located at the opposite side (side at which the second connector 4, which will be described later, is located) correspond to the second connection portions 31*b*.

Figure 5:
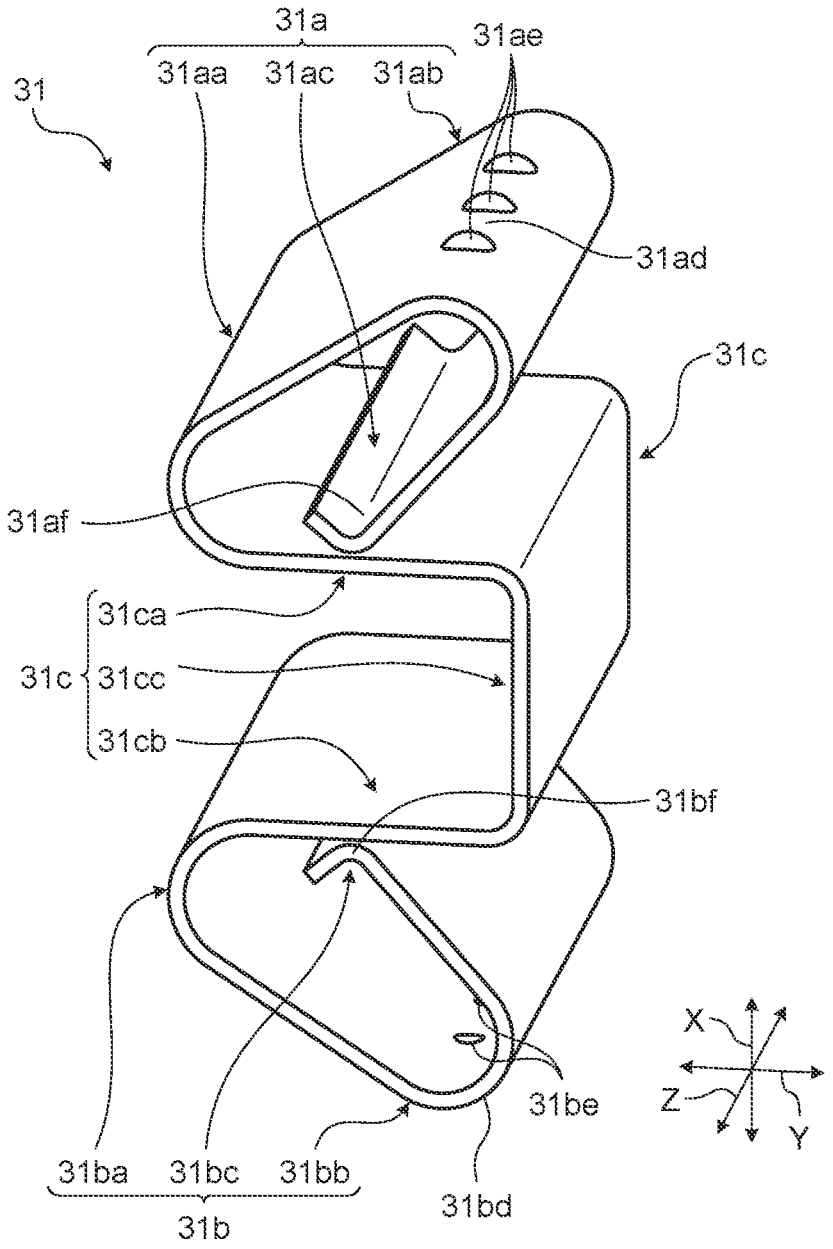
FIG. 5 is a perspective view illustrating the schematic configuration of a relay terminal included in the connection device in the embodiment.
Figure 6:
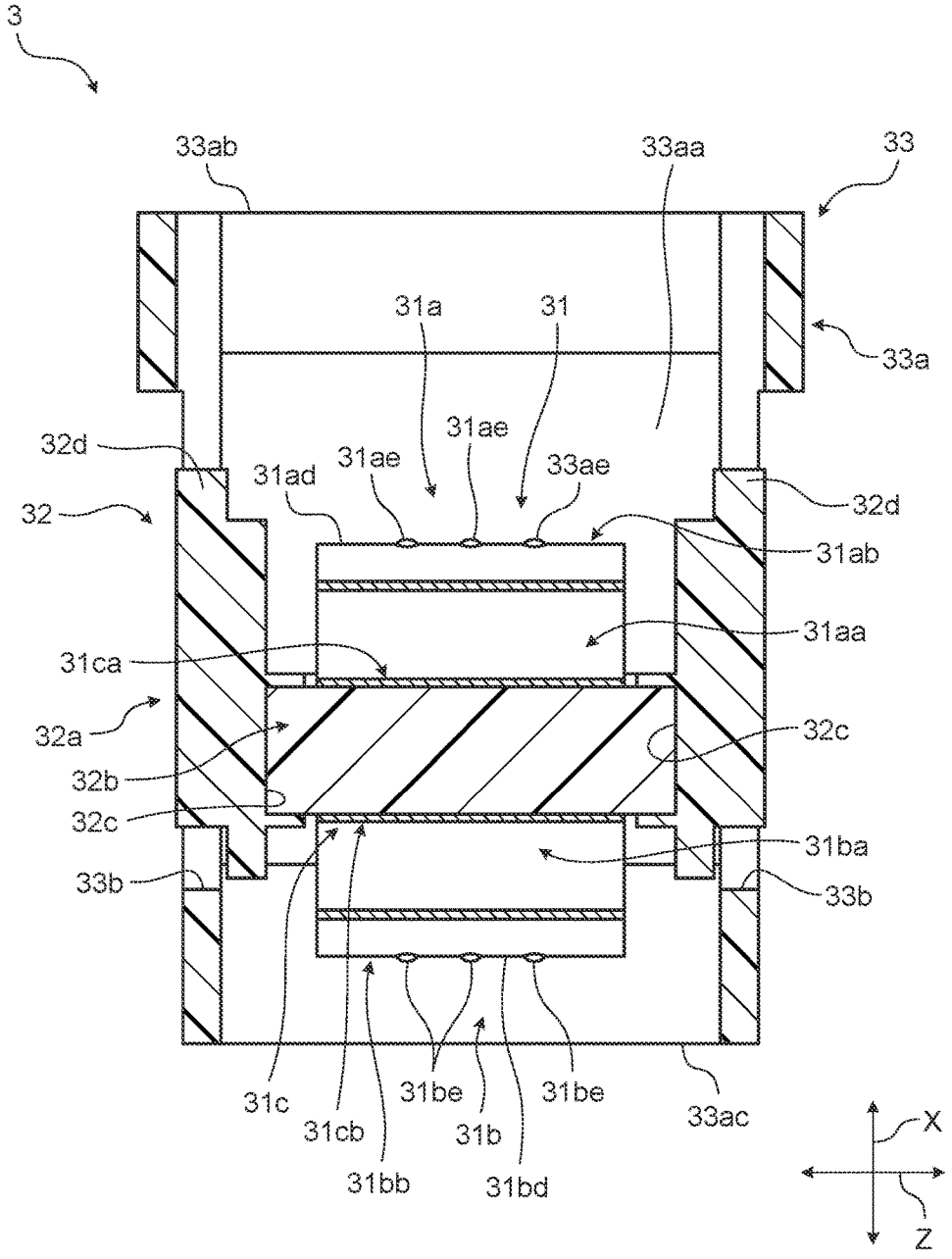
FIG. 6 is a cross-sectional view illustrating the schematic configuration of the relay connector included in the connection device in the embodiment.

To be more specific, as illustrated in FIG. 5 and the like, each first connection portion 31*a* has a first base end portion 31*aa*, a first elastic bending portion 31*ab*, and a first front end portion 31*ac*. Each second connection portion 31*b* has a second base end portion 31*ba*, a second elastic bending portion 31*bb*, and a second front end portion 31*bc*. Each coupling portion 31*c* has a first base portion 31*ca*, a second base portion 31*cb*, and a connecting portion 31*cc*. Each relay terminal 31 is formed to have a substantially ω (omega) shape overall by, for example, integrally shaping the respective portions with press processing on sheet metal having a substantially oblong plate shape, and combining them.

The first base end portion 31*aa* is a portion of the first connection portion 31*a* that is continuous to the first base portion 31*ca* of the coupling portion 31*c*. The first base portion 31*ca* is a portion of the coupling portion 31*c* to which the first connection portion 31*a* is connected and is formed into a substantially rectangular plate shape such that the plate thickness direction is the axial direction X. The first base end portion 31*aa* of the first connection portion 31*a* is formed so as to be continuous to one end portion of the first base portion 31*ca* of the coupling portion 31*c* in the first width direction Y and rise from the end portion of the first base portion 31*ca* while being curved to one side in the axial direction X. The first elastic bending portion 31*ab* is formed so as to be continuous to the first base end portion 31*aa* at one side in the axial direction X while being bent and can abut against the first connection surface 21*e* of the first counterpart terminal 21. In this example, the first elastic bending portion 31*ab* is formed so as to be continuous from an end portion of the first base end portion 31*aa* at the opposite side to the first base portion 31*ca* toward one side in the axial direction X, and is formed to be folded back while being curved to the other side in the axial direction X, that is, to the first base portion 31*ca* side after passing through a top portion 31*ad*. The first elastic bending portion 31*ab* can be elastically deformed while being deflected along the axial direction X. Indent portions 31*ae* are formed in the top portion 31*ad* of the first elastic bending portion 31*ab*. The indent portions 31*ae* are formed so as to project to one side in the axial direction X in hemisphere-like forms and form contact points as electric connection sites with the first connection surface 21*e* of the first counterpart terminal 21. The three indent portions 31*ae* are provided with intervals along the second width direction Z. The first front end portion 31*ac* is continuous to the first elastic bending portion 31*ab* at the opposite to the first base end portion 31*aa* and supports the first elastic bending portion 31*ab* on the first base portion 31*ca* of the coupling portion 31*c*. The first front end portion 31*ac* is formed so as to be continuous from an end portion of the first elastic bending portion 31*ab* at the opposite side to the first base end portion 31*aa* and is formed to be folded back to the first base end portion 31*aa* side after passing through a top portion 31*af*. The top portion 31*af* abuts against the surface of the first base portion 31*ca* of the coupling portion 31*c* at one side in the axial direction X and configures a support point for supporting the first elastic bending portion 31*ab* on the first base portion 31*ca*.

The second base end portion 31*ba* is a portion of the second connection portion 31*b* that is continuous to the second base portion 31*cb* of the coupling portion 31*c*. The second base portion 31*cb* is a portion of the coupling portion 31*c* to which the second connection portion 31*b* is connected and is formed into a substantially rectangular plate shape such that the plate thickness direction is the axial direction X. The second base portion 31*cb* is located so as to oppose the first base portion 31*ca* with an interval in the axial direction X. The second base portion 31*cb* is connected to the first base portion 31*ca* through the connecting portion 31*cc*. The connecting portion 31*cc* is formed into a substantially rectangular plate shape such that the plate thickness direction is the first width direction Y and connects the first base portion 31*ca* and the second base portion 31*cb* along the axial direction X. The second base end portion 31*ba* of the second connection portion 31*b* is formed so as to be continuous to one end portion of the second base portion 31*cb* of the coupling portion 31*c* in the first width direction Y, to be specific, an end portion at the same side as the side at which the first base end portion 31*aa* is provided and rise from the end portion of the second base portion 31*cb* while being curved to the other side (opposite side to the curved side of the first base end portion 31*aa*) in the axial direction X. The connecting portion 31*cc* configuring the coupling portion 31*c* connects the other end portion (end portion at the opposite side to the second base end portion 31*ba*) of the second base portion 31*cb* in the first width direction Y and the other end portion (end portion at the opposite side to the first base end portion 31*aa*) of the first base portion 31*ca* in the first width direction Y. The second elastic bending portion 31*bb* is formed so as to be continuous to the second base end portion 31*ba* at the other side in the axial direction X while being bent and can abut against a second connection surface 41*d* of the second counterpart terminal 41. In this example, the second elastic bending portion 31*bb* is formed so as to be continuous from an end portion of the second base end portion 31*ba* at the opposite side to the second base portion 31*cb* toward the other side in the axial direction X, and is formed to be folded back while being curved to one side in the axial direction X, that is, to the second base portion 31*cb* side after passing through a top portion 31*bd*. The second elastic bending portion 31*bb* can be elastically deformed while being deflected along the axial direction X. Indent portions 31*be* are formed on the top portion 31*bd* of the second elastic bending portion 31*bb*. The indent portions 31*be* are formed so as to project to the other side in the axial direction X in hemisphere-like forms and form contact points as electric connection sites with the second connection surface 41*d* of the second counterpart terminal 41, which will be described later. The three indent portions 31*be* are provided with intervals along the second width direction Z. The second front end portion 31*bc* is continuous to the second elastic bending portion 31*bb* at the opposite side to the second base end portion 31*ba* and supports the second elastic bending portion 31*bb* on the second base portion 31*cb* of the coupling portion 31*c*. The second front end portion 31*bc* is formed so as to be continuous from an end portion of the second elastic bending portion 31*bb* at the opposite side to the second base end portion 31*ba* and is formed to be folded back to the second base end portion 31*ba* side after passing through a top portion 31*bf*. The top portion 31*bf* abuts against the surface of the second base portion 31*cb* of the coupling portion 31*c* at the other side in the axial direction X and configures a support point that supports the second elastic bending portion 31*bb* on the second base portion 31*cb*.

The holding unit 32 holds the relay terminals 31. The holding unit 32 is made of an insulating resin material. The holding unit 32 in the embodiment is formed separately from the relay housing 33 and is assembled on the relay housing 33. The holding unit 32 supports the relay terminals 31 on the relay housing 33. To be more specific, the holding unit 32 includes a frame-like portion 32*a* and rectangular beam portions 32*b* as reaction force receiving portions and supports the relay terminals 31 on the frame-like portion 32*a* through the rectangular beam portions 32*b*, and the frame-like portion 32*a* is supported on the relay housing 33. The holding unit 32 is configured by, for example, forming the frame-like portion 32*a* and the rectangular beam portions 32*b* separately, providing the relay terminals 31 on the rectangular beam portions 32*b*, and then, assembling the frame-like portion 32*a* and the rectangular beam portions 32*b* on each other. The three rectangular beam portions 32*b* are provided so as to correspond to the three relay terminals 31. The holding unit 32 holds the three relay terminals 31 in total in such a manner that one relay terminal 31 is held on each rectangular beam portion 32*b*.

The frame-like portion 32*a* is formed into a substantially oblong frame shape such that the longer side direction is the first width direction Y by combining a plurality of beam portions along the first width direction Y and a plurality of beam portions along the second width direction Z. The frame-like portion 32*a* includes support recess portions 32*c* for supporting the rectangular beam portions 32*b* on the beam portions along the first width direction Y. The one pair of support recess portions 32*c* support the one rectangular beam portion 32*b* (see FIG. 6 and the like in particular). The pair of support recess portions 32*c* are formed into substantially rectangular recessed shapes in the surfaces of the beam portions of the frame-like portion 32*a* along the first width direction Y that oppose each other in the second width direction Z at positions opposing each other in the second width direction Z. The three pairs of support recess portions 32*c* are provided with intervals along the first width direction Y so as to correspond to the three rectangular beam portions 32*b*. The frame-like portion 32*a* is provided with, on the beam portions along the first width direction Y, restriction projecting portions 32*d* formed for restricting relative movement of the holding unit 32 and the relay housing 33 along the axial direction X within a predetermined range. The restriction projecting portions 32*d* are provided on the beam portions of the frame-like portion 32*a* along the first width direction Y. On the beam portions of the frame-like portion 32*a* along the first width direction Y, one pair of restriction projecting portions 32*d* oppose each other in the second width direction Z and the three pairs thereof are provided with intervals along the first width direction Y. That is, the six restriction projecting portions 32*d* are provided in total. The respective restriction projecting portions 32*d* project along the second width direction Z from the beam portions of the frame-like portion 32*a* along the first width direction Y, and are formed into substantially rectangular columnar shapes along the axial direction X.

The respective rectangular beam portions 32*b* configure the reaction force receiving portions that support the coupling portions 31*c* of the relay terminals 31 and receive the reaction forces with the elastic deformation of the first connection portions 31*a* and the reaction forces with the elastic deformation of the second connection portions 31*b*. The rectangular beam portions 32*b* are made of, for example, a resin material having relatively high rigidity in order to receive the reaction forces with the elastic deformation of the first connection portions 31*a* and the second connection portions 31*b* more reliably. The rectangular beam portions 32*b* are formed into substantially rectangular beam shapes along the second width direction Z. The relay terminals 31 are assembled on the rectangular beam portions 32*b* such that the rectangular beam portions 32*b* are interposed between the first base portions 31*ca* and the second base portions 31*cb* of the coupling portions 31*c* in the axial direction X to support the coupling portions 31*c*. In other words, the relay terminals 31 are mounted on the rectangular beam portions 32*b* with such positional relation that the relay terminals 31 are inserted into space portions having substantially rectangular parallelepiped shapes surrounded by the first base portions 31*ca*, the second base portions 31*cb*, and the connecting portions 31*cc* of the coupling portion 31*c*. Both surfaces of the rectangular beam portions 32*b* in the axial direction X respectively abut against the first base portions 31*ca* and the second base portions 31*cb* and one of the surfaces of each of the rectangular beam portions 32*b* in the first width direction Y abuts against the connecting portions 31*cc* in a state in which the relay terminals 31 are mounted thereon. One end portion of each of the rectangular beam portions 32*b* in the second width direction Z is fitted into one of the pairs of support recess portions 32*c* and the other end portion thereof is fitted into the other of the pairs of support recess portions 32*c*. The rectangular beam portions 32*b* are thereby supported on the frame-like portion 32*a* (see FIG. 6 and the like in particular). This configuration enables the rectangular beam portions 32*b* to support the coupling portions 31*c* of the relay terminals 31 on the frame-like portion 32*a*.

Figure 7:
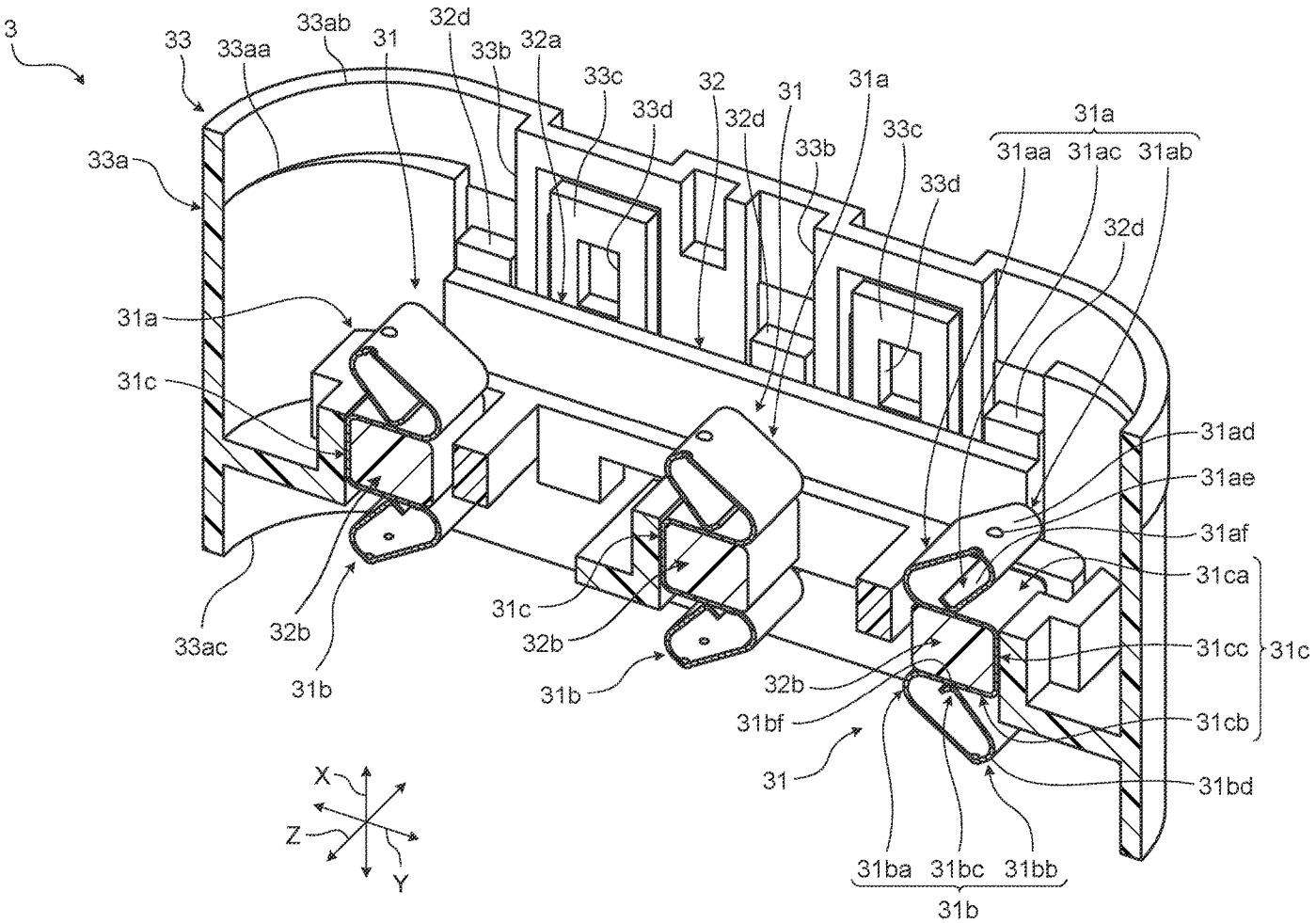
FIG. 7 is a cross-sectional perspective view illustrating the schematic configuration of the relay connector included in the connection device in the embodiment.

The holding unit 32 configured as described above holds the three relay terminals 31 in total with intervals along the first width direction Y by the three rectangular beam portions 32*b* (see FIG. 7 and the like in particular). The first base portions 31*ca* and the second base portions 31*cb* of the relay terminals 31 are located at both sides of the rectangular beam portions 32*b* in the axial direction X in a state in which the coupling portions 31*c* thereof are supported on the rectangular beam portions 32*b* of the holding unit 32. That is to say, the second base portions 31*cb* are located at the opposite side to the first base portions 31*ca* with the rectangular beam portions 32*b* interposed therebetween in the axial direction X and the first base portions 31*ca* and the second base portions 31*cb* oppose each other with the rectangular beam portions 32*b* interposed therebetween in the axial direction X. Furthermore, the top portions 31*af* of the first front end portions 31*ac* of the relay terminals 31 are supported on the first base portions 31*ca* and are supported on the rectangular beam portions 32*b* through the first base portions 31*ca*. In the same manner, the top portions 31*bf* of the second front end portions 31*bc* of the relay terminals 31 are supported on the second base portions 31*cb* and are supported on the rectangular beam portions 32*b* through the second base portions 31*cb*.

The holding unit 32 holding the relay terminals 31 on the rectangular beam portions 32*b* is assembled on the relay housing 33 and the relay housing 33 is mounted on the mounting portion 22*b* of the first housing 22. The relay housing 33 is made of an insulating resin material. The relay housing 33 includes a main body portion 33*a*, restriction slit portions 33*b*, and arm portions 33*c*, and the whole is integrally formed.

Figure 9:
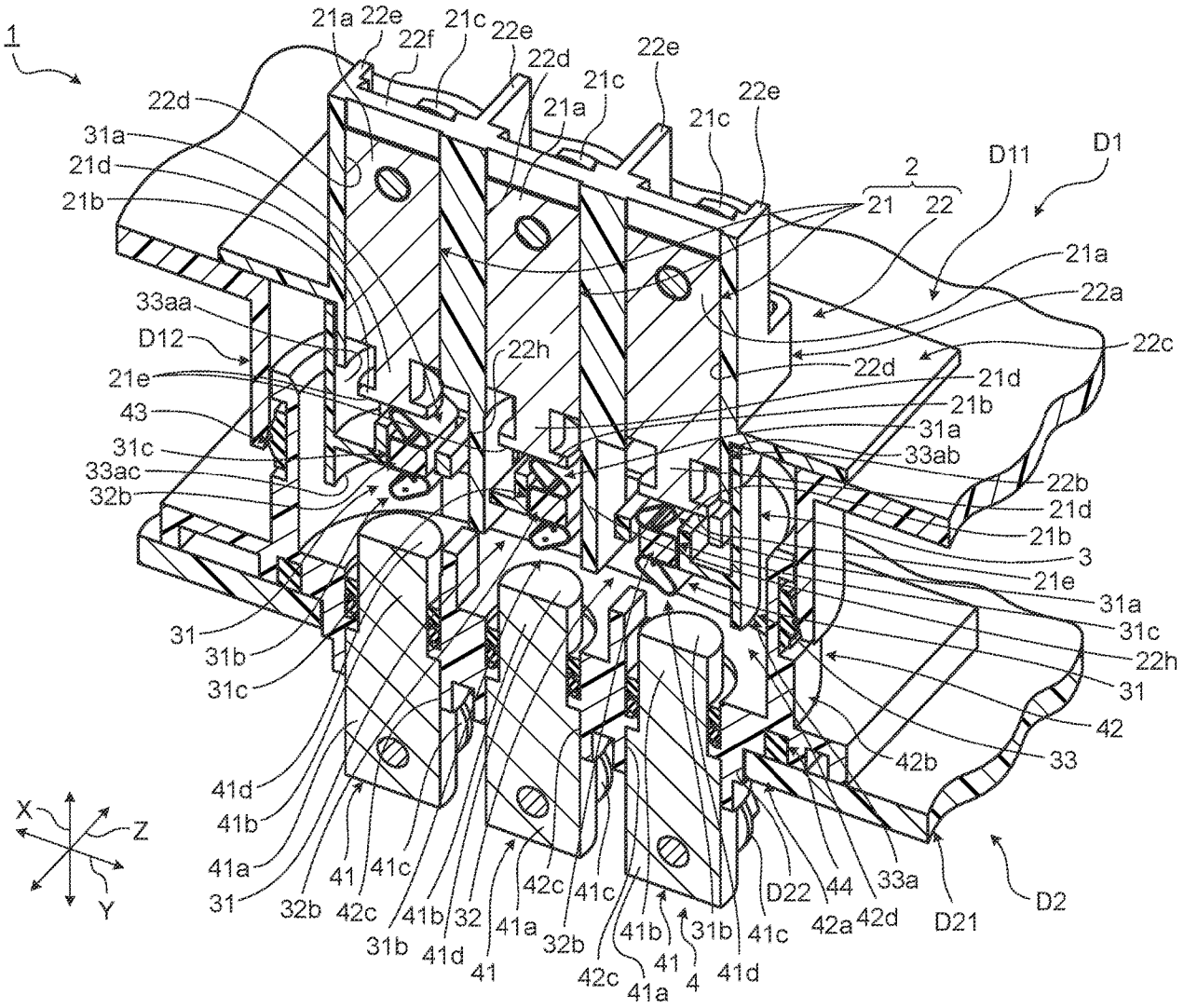
FIG. 9 is a partial cross-sectional perspective view illustrating operations of the connection device in the embodiment.

The main body portion 33*a* is a main portion on which the holding unit 32 is assembled. The main body portion 33*a* is formed into a substantially long cylindrical shape that is smaller than the fitting hood portion D12 and is larger than the mounting portion 22*b* of the first housing 22 (also see FIG. 9 and the like). To be more specific, the main body portion 33*a* includes an accommodation space portion 33*aa*, a first insertion hole 33*ab*, and a second insertion hole 33*ac*. The accommodation space portion 33*aa* is a space portion formed in an inner portion having a hollow shape and accommodates therein the holding unit 32 holding the relay terminals 31 such that the holding unit 32 is relatively movable along the axial direction X. The accommodation space portion 33*aa* is opened to both sides in the axial direction X. The first insertion hole 33*ab* is configured by one opening of the accommodation space portion 33*aa* in the axial direction X and the second insertion hole 33*ac* is configured by the other opening of the accommodation space portion 33*aa* in the axial direction X. That is to say, the first insertion hole 33*ab* is opened to one side in the axial direction X and communicates with the accommodation space portion 33*aa* and the first counterpart terminals 21 can be inserted through the first insertion hole 33*ab* along the axial direction X. The main body portion 33*a* can be fitted with the mounting portion 22*b* of the first housing 22 at the inner circumferential surface side from the first insertion hole 33*ab* side. On the other hand, the second insertion hole 33*ac* is opened to the other side in the axial direction X and communicates with the accommodation space portion 33*aa* and the second counterpart terminals 41, which will be described later, can be inserted through the second insertion hole 33*ac* along the axial direction X. The main body portion 33*a* also includes a plurality of beam portions along the second width direction Z in the accommodation space portion 33*aa*, and the like.

The restriction slit portions 33*b* are portions into which the restriction projecting portions 32*d* of the holding unit 32 are inserted. The restriction slit portions 33*b* are formed so as to penetrate through a wall body of the main body portion 33*a* along the second width direction Z and linearly extend along the axial direction X (see FIG. 6 and the like in particular). The six restriction slit portions 33*b* in total are provided in such a manner that one restriction slit portion 33*b* is provided at each of the positions corresponding to the six restriction projecting portions 32*d*. That is to say, in a plurality of wall surfaces of the main body portion 33*a* along the first width direction Y, one pair of restriction slit portions 33*b* oppose each other in the second width direction Z and three pairs thereof are provided with intervals along the first width direction Y. That is, six restriction slit portions 33*b* in total are provided. The restriction slit portions 33*b* are opened to one side in the axial direction X, in this example, the side at which the mounting portion 22*b* is located in a state in which the relay housing 33 is mounted on the mounting portion 22*b* of the first housing 22, that is, to the first insertion hole 33*ab* side (see FIG. 3, FIG. 6, FIG. 7 and the like in particular). The holding unit 32 is assembled on the main body portion 33*a* of the relay housing 33 with such positional relation that the respective restriction projecting portions 32*d* are inserted into the main body portion 33*a* through the openings of the restriction slit portions 33*b* at one side in the axial direction X, that is, through the openings thereof at the first insertion hole 33*ab* side. In this state, the holding unit 32 and the respective relay terminals 31 held in the holding unit 32 are made into a state of being accommodated in the accommodation space portion 33*aa* at the inner circumferential surface side of the main body portion 33*a*. The holding unit 32 is positioned relative to the relay housing 33 and is relatively movable along the axial direction X together with the relay terminals 31 in a state in which the respective restriction projecting portions 32*d* are located in the respective restriction slit portions 33*b*. The holding unit 32 is prevented from dropping to the second insertion hole 33*ac* side in the axial direction X because the respective restriction projecting portions 32*d* abut against end portions of the respective restriction slit portions 33*b* at the second insertion hole 33*ac* side in the axial direction X.

The arm portions 33*c* are locked by the locking claw portions 22*g* formed on the mounting portion 22*b* of the first housing 22. The four arm portions 33*c* in total are formed in such a manner that one arm portion 33*c* is provided at each place between the restriction slit portions 33*b* in the first width direction Y. The arm portions 33*c* extend in bar-like forms along the axial direction X while base end portions thereof are supported on the wall body of the main body portion 33*a* in a cantilever state and front end portions thereof are free ends, and can be elastically deformed along the second width direction Z with the base end portions as support points. The base end portions of the arm portions 33*c* are located at the second insertion hole 33*ac* side and the front end portions thereof are located at the first insertion hole 33*ab* side. Locking recess portions 33*d* are formed on the front end portions of the arm portions 33*c*. The locking recess portions 33*d* are recess portions that are locked with the locking claw portions 22*g*, and in this example, are formed as through-holes penetrating through the front end portions of the arm portions 33*c* along the second width direction Z.

With the relay connector 3 configured as described above, the relay housing 33 is mounted on the mounting portion 22*b* of the first housing 22 by causing the locking recess portions 33*d* of the respective arm portions 33*c* to be locked with the locking claw portions 22*g* of the mounting portion 22*b* in the state in which the holding unit 32 holding the respective relay terminals 31 are assembled on the relay housing 33. In this state, the holding unit 32 holds the respective relay terminals 31 with such positional relation that the first counterpart terminals 21 can be connected to the first connection portions 31*a* of the respective relay terminals 31 from one side in the axial direction X and the second counterpart terminals 41, which will be described later, can be connected to the second connection portions 31*b* from the other side in the axial direction X in the accommodation space portion 33*aa*. That is to say, the first connection portions 31*a* of the respective relay terminals 31 are located at the mounting portion 22*b* side and the second connection portions 31*b* thereof are located at the opposite side to the mounting portion 22*b* side in the axial direction X in the state in which the respective relay terminals 31 are held in the holding unit 32 and the relay connector 3 is mounted on the mounting portion 22*b* of the first housing 22. With this configuration, the relay connector 3 has the configuration in which the first counterpart terminals 21 can be connected to the first connection portions 31*a* of the respective relay terminals 31 from one side in the axial direction X through the first insertion hole 33*ab* and the second counterpart terminals 41, which will be described later, can be connected to the second connection portions 31*b* of the respective relay terminals 31 from the other side in the axial direction X through the second insertion hole 33*ac*. The relay connector 3 is adjusted, in a state of, for example, being mounted on the mounting portion 22*b*, such that the first connection surfaces 21*e* of the respective first counterpart terminals 21 and the indent portions 31*ae* of the first connection portions 31*a* of the respective relay terminals 31 abut against each other and the first connection portions 31*a* are elastically deformed along the axial direction X. With this configuration, the relay connector 3 absorbs assembling tolerance along the axial direction X by the first connection portions 31*a* by causing the first connection portions 31*a* to abut against the first connection surfaces 21*e* of the respective first counterpart terminals 21 and to be elastically deformed along the axial direction X. The relay connector 3 ensures contact pressures along the axial direction X for the contact points as the electric connection sites formed between the first counterpart terminals 21 and the relay terminals 31 with restoring forces of the elastically deformed first connection portions 31*a*.

Figure 8:
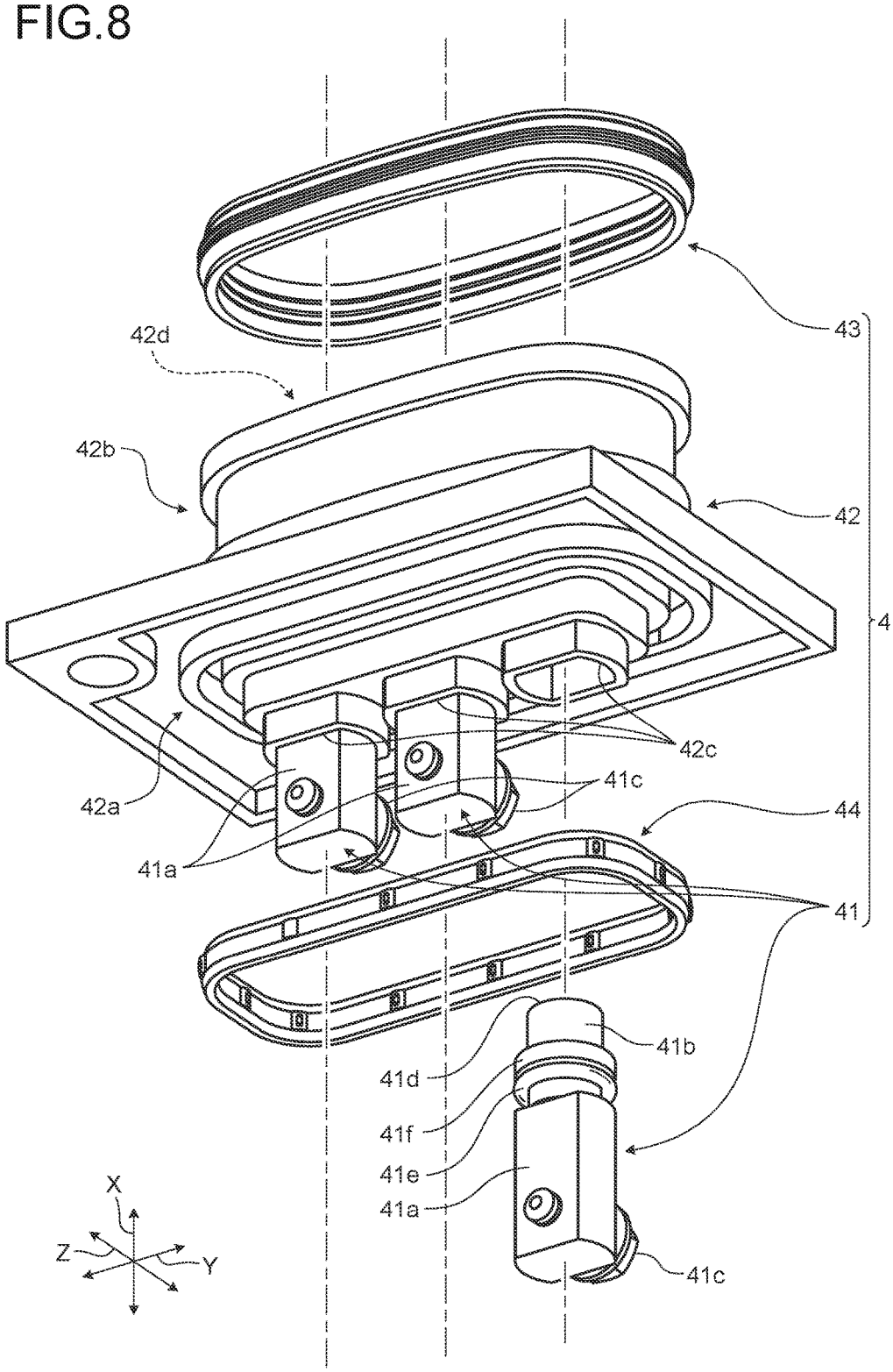
FIG. 8 is an exploded perspective view illustrating the schematic configuration of a second connector included in the connection device in the embodiment.

As illustrated in FIG. 1, FIG. 2, and FIG. 8, the second connector 4 includes the second counterpart terminals 41, a second housing 42, a packing 43, and a packing 44, and the second counterpart terminals 41 are provided in the second housing 42 along the axial direction X.

The second counterpart terminals 41 are metal fittings formed into columnar shapes with a conductive metal material and configure the second connector 4 that is provided in the second device D2. The second counterpart terminals 41 are formed into columnar shapes about center axis lines along the axial direction X and are formed so as to extend along the axial direction X. In this example, the second counterpart terminals 41 are formed into substantially cylindrical shapes parts of which are planarly chamfered. The second counterpart terminals 41 include connection end portions 41*a* formed at one side in the axial direction X and connection end portions 41*b* formed at the other side in the axial direction X. The connection end portions 41*a* are formed by planarly chamfering parts of the substantially cylindrical shapes and components of the second device D2 as the motor are electrically connected thereto. The second counterpart terminals 41 are assembled into terminal insertion holes 42*c* of the second housing 42, which will be described later, and then, the components of the second device D2 are electrically connected to the connection end portions 41*a* through fastening bolts 41*c* and the like. The connection end portions 41*b* are formed into substantially cylindrical shapes about the center axis lines along the axial direction X. The second counterpart terminals 41 have the second connection surfaces 41*d* that are formed planarly along the first width direction Y and the second width direction Z as the intersection directions orthogonal to (intersecting with) the axial direction X and abut against the second connection portions 31*b* of the relay terminals 31. The second connection surfaces 41*d* are configured by the surfaces of the connection end portions 41*b* that face the relay terminals 31 in the axial direction X, in this example, by the end surfaces thereof at the opposite side to the connection end portions 41*a*. The indent portions 31*be* of the second connection portions 31*b* of the relay terminals 31 abut against the second connection surfaces 41*d* of the connection end portions 41*b* of the second counterpart terminals 41. With this configuration, contact points as electric connection sites are formed between the second counterpart terminals 41 and the relay terminals 31. In the second counterpart terminals 41, O-rings 41*e* for stopping water to and from the second connector 4, rings 41*f* for reducing backlash in the first width direction Y and the second width direction Z, and the like are mounted on the connection end portions 41*b*. The second counterpart terminals 41 configured as described above for three phases corresponding to the three-phase AC power, that is, the three second counterpart terminals 41 are provided.

The second housing 42 is provided with the second counterpart terminals 41 along the axial direction X and accommodates and holds therein the second counterpart terminals 41. The second housing 42 is made of an insulating resin material. The second housing 42 includes a main body portion 42*a*, a hood portion 42*b*, and the terminal insertion holes 42*c*, and the whole is integrally formed.

The main body portion 42*a* holds the second counterpart terminals 41 along the axial direction X. The main body portion 42*a* is formed into a substantially rectangular plate shape. The hood portion 42*b* is formed into a substantially long cylindrical shape that is smaller than the fitting hood portion D12 and is larger than the main body portion 33*a* of the relay housing 33 (also see FIG. 9 and the like). The hood portion 42*b* is formed so as to extend from the main body portion 42*a* along the axial direction X. The hood portion 42*b* is formed to have an outer shape that can be fitted with the fitting hood portion D12 at the inner circumferential surface side. A space portion of the hood portion 42*b* at the inner circumferential surface side configures a fitting space portion 42*d*. The fitting space portion 42*d* is formed as a space portion into which the main body portion 33*a* of the relay housing 33 is fitted so as to have such size and shape that the main body portion 33*a* can be fitted thereinto in accordance with the outer shape of the main body portion 33*a*. The terminal insertion holes 42*c* are formed in the main body portion 42*a* along the axial direction X. The terminal insertion holes 42*c* are formed into hollow shapes so as to penetrate through the main body portion 42*a* along the axial direction X. The terminal insertion holes 42*c* are space portions into which the second counterpart terminals 41 can be inserted along the axial direction X and that hold therein the second counterpart terminals 41. The terminal insertion holes 42*c* are formed so as to extend along the axial direction X and are also referred to as cavities. The connection end portions 41*b* of the second counterpart terminals 41 are inserted into the terminal insertion holes 42*c* from, for example, one side in the axial direction X and the terminal insertion holes 42*c* hold therein the second counterpart terminals 41 with such positional relation that the center axis lines thereof are along the axial direction X. Alternatively, the second housing 42 may be formed by insertion molding or the like in the state in which the second counterpart terminals 41 are held in the terminal insertion holes 42*c*. The second counterpart terminals 41 are held in the terminal insertion holes 42*c* of the second housing 42 with such positional relation that the connection end portions 41*b* are exposed to the fitting space portion 42*d* of the hood portion 42*b* in the state in which the counterpart terminals 41 are held in the terminal insertion holes 42*c*. The three terminal insertion holes 42*c* are provided to be aligned along the first width direction Y so as to correspond to the three second counterpart terminals 41.

The packings 43 and 44 are sealing members formed into ring shapes. The packings 43 and 44 are made of an insulating resin material. The packing 43 is mounted on the hood portion 42*b* of the second housing 42 at the outer circumferential surface side and is interposed between the fitting hood portion D12 of the first device D1 and the hood portion 42*b* (also see FIG. 9 and the like). The packing 43 makes contact with the inner circumferential surface of the fitting hood portion D12 and the outer circumferential surface of the hood portion 42*b* and seals between the inner circumferential surface of the fitting hood portion D12 and the outer circumferential surface of the hood portion 42*b*. The packing 44 is mounted on the surface of the main body portion 42*a* of the second housing 42 at the opposite side to the hood portion 42*b*. The packing 44 is provided so as to collectively surround the three second counterpart terminals 41 about the axial direction X and is interposed between the casing D21 of the second device D2 and the main body portion 42*a* (also see FIG. 9 and the like). The packing 44 makes contact with the main body portion 42*a* and the casing D21 and seals between the main body portion 42*a* and the casing D21.

With the connection device 1 configured as described above, as illustrated in FIG. 9, the first connector 2 is assembled on the casing D11 of the first device D1 and the components of the first device D1 are electrically connected to the connection end portions 21*a* of the first counterpart terminals 21 with such positional relation that the mounting portion 22*b* is exposed into the fitting hood portion D12 of the casing D11. The relay connector 3 of the connection device 1 is inserted into the fitting hood portion D12 and is mounted on the mounting portion 22*b* of the first connector 2 with such positional relation that the mounting portion 22*b* is fitted with the main body portion 33*a*. In this state, in the connection device 1, the first counterpart terminals 21 abut against the first connection portions 31*a* of the respective relay terminals 31 from one side in the axial direction X through the first insertion hole 33*ab* of the relay connector 3 and are electrically connected thereto while elastically deforming the first connection portions 31*a* along the axial direction X. In the connection device 1, the elastically deformed first connection portions 31*a* apply predetermined contact pressures to the contact points between the first connection portions 31*a* and the first counterpart terminals 21, that is, the contact points between the indent portions 31*ae* and the first connection surfaces 21*e*. In this state, the relay connector 3 is in the state in which the holding unit 32 is movable relatively to the relay housing 33 along the axial direction X within a predetermined range. Accordingly, the respective relay terminals 31 held in the holding unit 32 are also movable, together with the holding unit 32, relatively to the first connection surfaces 21*e* of the first counterpart terminals 21 along the axial direction X within a predetermined range. The second connector 4 of the connection device 1 is assembled on the casing D21 and the components of the second device D2 are electrically connected to the connection end portions 41*a* of the second counterpart terminals 41 with such positional relation that the second counterpart terminals 41 are inserted through the communication hole portion D22 of the casing D21 of the second device D2.

Figure 10:
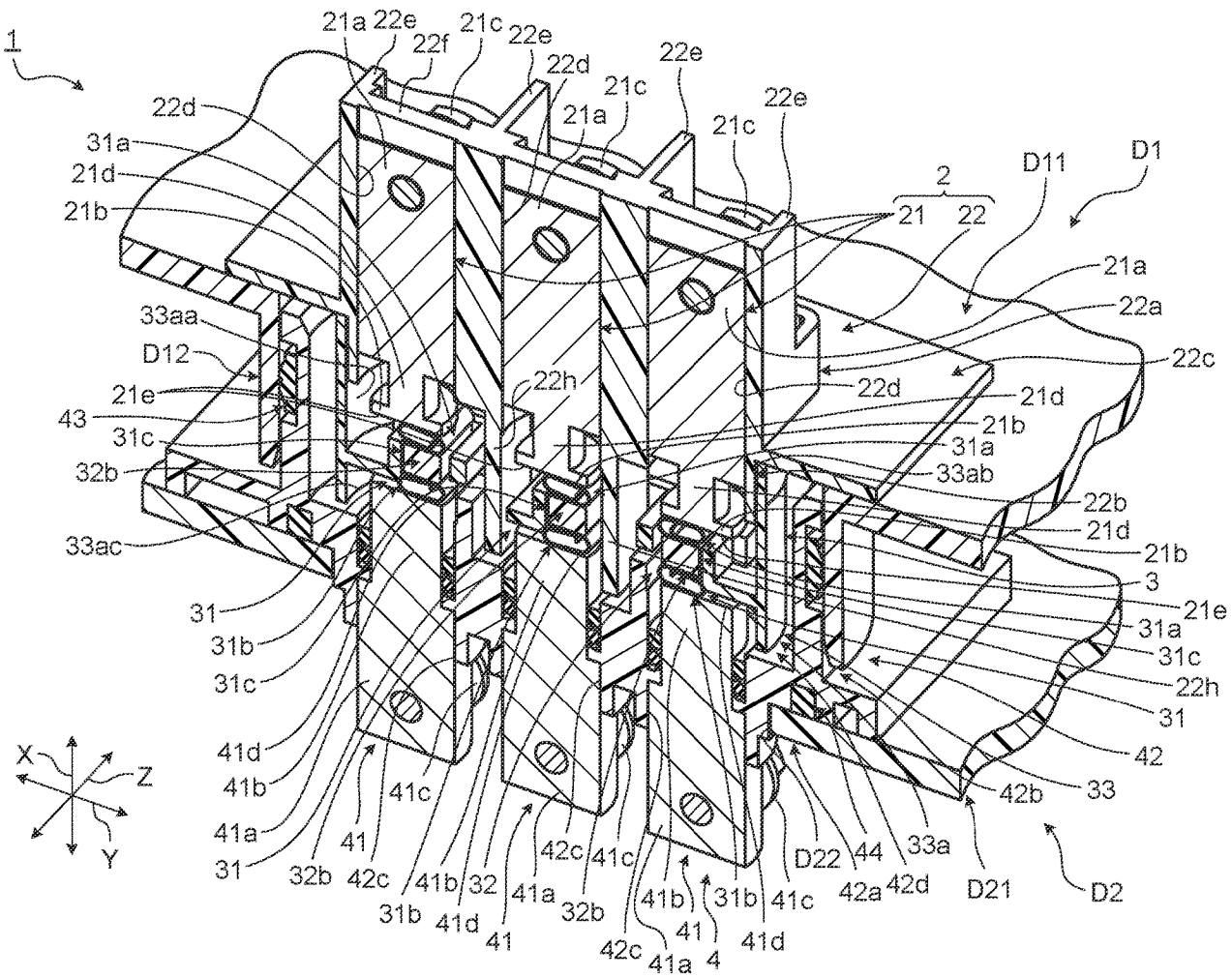
FIG. 10 is a partial cross-sectional perspective view illustrating the operations of the connection device in the embodiment.

In the connection device 1, the relay connector 3 and the second connector 4 are fitted with each other along the axial direction X together with the first device D1 and the second device D2 with such positional relation that the hood portion 42*b* of the second connector 4 is fitted with the fitting hood portion D12 at the inner circumferential surface side and the main body portion 33*a* of the relay housing 33 is inserted into the fitting space portion 42*d* at the inner side of the hood portion 42*b*. In the connection device 1, the first connector 2, the relay connector 3, and the second connector 4 are pressed in the direction of approximating each other along the axial direction X together with the first device D1 and the second device D2. With the pressing, as illustrated in FIG. 10, the respective second counterpart terminals 41 abut against the second connection portions 31*b* of the respective relay terminals 31 from the other side in the axial direction X through the second insertion hole 33*ac* of the relay connector 3 and are electrically connected thereto while elastically deforming the second connection portions 31*b* along the axial direction X. In the connection device 1, the elastically deformed second connection portions 31*b* apply predetermined contact pressures to the contact points between the second connection portions 31*b* and the second counterpart terminals 41, that is, the contact points between the indent portions 31*be* and the second connection surfaces 41*d*. With this configuration, the connection device 1 can electrically connect the first counterpart terminals 21 and the second counterpart terminals 41 through the relay terminals 31. With the connection device 1, for example, the casing D11 of the first device D1 and the casing D21 of the second device D2 are fastened with each other in a state in which the hood portion 42*b* is fitted with the fitting hood portion D12 at the inner circumferential surface side and the main body portion 33*a* of the relay housing 33 is inserted into the fitting space portion 42*d* at the inner side of the hood portion 42*b* to properly connect the first counterpart terminals 21, the relay terminals 31, and the second counterpart terminals 41, thereby keeping the above-mentioned fitting state.

The connection device 1 and the relay connector 3 described above can electrically connect the first counterpart terminals 21 and the second counterpart terminals 41 through the first connection portions 31*a*, the coupling portions 31*c*, and the second connection portions 31*b* of the relay terminals 31. In this case, the relay terminals 31 are held in the holding unit 32 in the state in which the coupling portions 31*c* connecting the first connection portions 31*a* and the second connection portions 31*b* are supported on the rectangular beam portions 32*b*, and the rectangular beam portions 32*b* receive the reaction forces with the elastic deformation of the first connection portions 31*a* and the reaction forces with the elastic deformation of the second connection portions 31*b*. With this configuration, the connection device 1 and the relay connector 3 enable the first connection portions 31*a* and the second connection portions 31*b* to be elastically deformed independently, thereby individually absorbing assembling tolerance at the side of the first counterpart terminals 21 along the axial direction X and assembling tolerance at the side of the second counterpart terminals 41 along the axial direction X by the first connection portions 31*a* and the second connection portions 31*b*, respectively. The connection device 1 and the relay connector 3 can individually absorb the respective assembling tolerances along the axial direction X by the first connection portions 31*a* and the second connection portions 31*b*, that is, absorb the assembling tolerances along the axial direction X at two places, thereby relatively reducing the assembling tolerance that should be absorbed at one side. With this configuration, the connection device 1 and the relay connector 3 can prevent the outer shapes of the entire tolerance absorbing sites from being increased in size.

In addition, the connection device 1 and the relay connector 3 can properly ensure the contact pressures at the contact points between the first connection portions 31*a* and the first counterpart terminals 21 and the contact pressures at the contact points between the second connection portions 31*b* and the second counterpart terminals 41 with the restoring forces of the first connection portions 31*a* and the restoring forces of the second connection portions 31*b* that are elastically deformed independently with the rectangular beam portions 32*b* serving as the reaction force receiving portions as described above. That is to say, the connection device 1 and the relay connector 3 can sufficiently ensure the contact pressures along the axial direction X at the contact points formed between the relay terminals 31 and the first counterpart terminals 21 by causing the indent portions 31*ae* forming the contact points with the first counterpart terminals 21 to be pressed to the side of the first connection surfaces 21*e* along the axial direction X with the restoring forces of the elastically deformed first connection portions 31*a*. In the same manner, the connection device 1 and the relay connector 3 can sufficiently ensure the contact pressures along the axial direction X at the contact points formed between the relay terminals 31 and the second counterpart terminals 41 by causing the indent portions 31*be* forming the contact points with the second counterpart terminals 41 to be pressed to the side of the second connection surfaces 41*d* along the axial direction X with the restoring forces of the elastically deformed second connection portions 31*b*. In other words, the relay terminals 31 are formed so as to have spring properties capable of applying sufficient contact pressures along the axial direction X to the contact points between the relay terminals 31 and the first counterpart terminals 21 and the contact points between the relay terminals 31 and the second counterpart terminals 41 with the restoring forces of the elastically deformed first connection portions 31*a* and the elastically deformed second connection portions 31*b* in a state in which the first connector 2, the relay connector 3, and the second connector 4 are fitted with each other and the first counterpart terminals 21, the relay terminals 31, and the second counterpart terminals 41 are properly connected to each other. With this configuration, the connection device 1 and the relay connector 3 can individually ensure the contact pressures necessary for the electric connection between the relay terminals 31 and the first counterpart terminals 21 and the electric connection between the relay terminals 31 and the second counterpart terminals 41 reliably, thereby stabilizing the contact points. In the connection device 1, relatively high-voltage electric power is transferred between the first counterpart terminals 21 and the second counterpart terminals 41 through the relay terminals 31. In this configuration where more reliable formation of the contact points is required, reliability of the contact points in the high-voltage system is capable of being improved because the contact pressures at the contact points can be ensured reliably as described above.

In the connection device 1 and the relay connector 3 described above, the first elastic bending portions 31*ab* of the first connection portions 31*a* that are connected to the first counterpart terminals 21 are supported on the coupling portions 31*c* through the first front end portions 31*ac* continuous to the first elastic bending portions 31*ab* at the opposite to the first base end portions 31*aa*. In the connection device 1 and the relay connector 3, the second elastic bending portions 31*bb* of the second connection portions 31*b* that are connected to the second counterpart terminals 41 are supported on the coupling portions 31*c* through the second front end portions 31*bc* continuous to the second elastic bending portions 31*bb* at the opposite to the second base end portions 31*ba*. With this configuration, the connection device 1 and the relay connector 3 enable the first elastic bending portions 31*ab* and the second elastic bending portions 31*bb* of the first connection portions 31*a* and the second connection portions 31*b*, which are elastically deformed, to be supported on the coupling portions 31*c* at both ends with the first base end portions 31*aa*, the second base end portions 31*ba*, the first front end portions 31*ac*, and the second front end portions 31*bc*. As a result, the connection device 1 and the relay connector 3 enable the rectangular beam portions 32*b* to reliably receive the reaction forces with the elastic deformation of the first connection portions 31*a* and the second connection portions 31*b*, thereby applying the contact pressures along the axial direction X to the respective contact points more reliably. Furthermore, the connection device 1 and the relay connector 3 have the configuration in which the first front end portions 31*ac* and the second front end portions 31*bc* move on the coupling portions 31*c* in a sliding manner along the first width direction Y in accordance with the elastic deformation of the first elastic bending portions 31*ab* and the second elastic bending portions 31*bb*, thereby sufficiently ensuring displacement amounts with the elastic deformation in the first connection portions 31*a* and the second connection portions 31*b*. With this configuration, the connection device 1 and the relay connector 3 can absorb tolerances with the elastic deformation of the first connection portions 31*a* and the second connection portions 31*b* and ensure the contact pressures at the respective contact points while preventing the outer shapes thereof from being increased in size.

In the connection device 1 and the relay connector 3 described above, the coupling portions 31*c* are configured by combining the first base portions 31*ca*, the second base portions 31*cb*, and the connecting portions 31*cc*. With this configuration, the connection device 1 and the relay connector 3 can have the configuration in which the rectangular beam portions 32*b* are capable of reliably receiving the reaction forces with the elastic deformation of the first connection portions 31*a* and the reaction forces with the elastic deformation of the second connection portions 31*b* through the first base portions 31*ca* and the second base portions 31*cb*.

In the connection device 1 and the relay connector 3 described above, the first counterpart terminals 21 are connected to the first connection portions 31*a* of the relay terminals 31 through the first insertion hole 33*ab* of the relay housing 33 and the second counterpart terminals 41 are connected to the second connection portions 31*b* of the relay terminals 31 through the second insertion hole 33*ac*. In the connection device 1 and the relay connector 3, positions of the relay terminals 31 along the axial direction X are adjusted by relatively moving the holding unit 32 along the axial direction X in the accommodation space portion 33*aa* of the relay housing 33 together with the relay terminals 31 in the state in which the relay terminals 31 are connected to the first counterpart terminals 21 and the second counterpart terminals 41. With this configuration, the connection device 1 and the relay connector 3 can easily position the relay terminals 31 at proper positions, easily and reliably absorb the tolerances, and ensure the contact pressures at the respective contact points.

In the connection device 1 and the relay connector 3 described above, the first counterpart terminals 21 and the second counterpart terminals 41 have the planar first connection surfaces 21*e* and the planar second connection surfaces 41*d*, respectively. The contact points between the first connection portions 31*a* and the second connection portions 31*b* of the relay terminals 31 and the first counterpart terminals 21 and the second counterpart terminals 41 can therefore be formed at any positions on the first connection surfaces 21*e* and the planar second connection surfaces 41*d*, respectively. With this configuration, in the connection device 1, deviation of the contact point positions between the relay terminals 31 and the first counterpart terminals 21 and the contact point positions between the relay terminals 31 and the second counterpart terminals 41 in the range of the planar first connection surfaces 21*e* and the planar second connection surfaces 41*d* can be allowed. The assembling tolerances along the first width direction Y and the second width direction Z can therefore be absorbed, thereby also stabilizing the contact points in this point.

In the connection device 1 and the relay connector 3 described above, the first counterpart terminals 21 configure the first connector 2 provided in the first device D1 and the second counterpart terminals 41 configure the second connector 4 provided in the second device D2. Accordingly, in the device-to-device connection device that relatively tends to generate assembling tolerance between the first device D1 and the second device D2, the connection device 1 and the relay connector 3 can absorb the assembling tolerance with the above-mentioned configuration. With this configuration, the connection device 1 and the relay connector 3 can easily assemble the first device D1 and the second device D2 to establish a stable contact point structure. Moreover, this configuration enables the connection device 1 and the relay connector 3 to absorb the assembling tolerances without providing, for example, an alignment structure between the first counterpart terminals 21 in the first device D1 and the second counterpart terminals 41 in the second device D2. With the connection device 1 and the relay connector 3, the first connector 2, the second connector 4, and the like can be formed by insertion molding together with the casings of the first device D1 and the second device D2, for example. In the connection device 1, this insertion molding can reduce the number of assembly components in the state in which the first device D1 and the second device D2 are assembled and, for example, reduce operation load in manufacturing and reduce manufacturing cost.

The above-mentioned connection device and the relay connector according to the embodiment of the present invention are not limited to the above-mentioned embodiment and various changes can be made in a range described in the scope of the invention.

Although the first device D1 and the second device D2 to which the connection device 1 described above is applied are mounted in, for example, the vehicles, and the first device D1 is the inverter and the second device D2 is the motor, the first device D1 and the second device D2 are not limited thereto. The first device D1 and the second device D2 may be mounted on, for example, apparatuses other than the vehicles, or may be applied to members other than the inverter and the motor in the vehicle.

Although the connection device 1 described above configures the device-to-device connection device, the connection device 1 is not limited to configure it and may configure a wire-to-device connection device or a wire-to-wire connection device.

Although both of the first counterpart terminals 21 and the second counterpart terminals 41 described above have respectively planarly formed first connection surfaces 21*e* and planarly formed second connection surfaces 41*d*, the first counterpart terminals 21 and the second counterpart terminals 41 are not limited to being planarly formed and one of them may have a planarly formed connection surface or neither of the first connection surfaces 21*e* nor the second connection surfaces 41*d* may have a planarly formed connection surface.

Although the relay connector 3 described above is assembled on the first connector 2, the relay connector 3 is not limited to be assembled thereon and may be assembled on the second connector 4 or may be assembled on neither of them. It is sufficient that the relay connector 3 is interposed between the first connector 2 and the second connector 4.

Although the relay connector 3 described above includes the holding unit 32 and the relay housing 33 that are separately formed, the relay connector 3 is not limited to be formed in this manner and the holding unit 32 and the relay housing 33 may be integrally formed or, for example, the relay connector 3 may not include the relay housing 33. When the relay housing 33 is not included, the holding unit 32 may be assembled, for example, so as to be movable relatively to the first counterpart terminals 21 and the second counterpart terminals 41 in the axial direction X in a predetermined range.

The rectangular beam portions 32*b* configuring the reaction force receiving portions described above may be formed by, for example, heat absorbing members that preferably absorb heat rather than other sites. In this case, heat generated in the relay terminals 31 can be preferably dissipated to other sites, thereby preventing heat from being accumulated in the vicinities of the relay terminals 31.

Although the relay terminals 31 described above are formed such that the first connection portions 31*a* and the second connection portions 31*b* have the substantially equivalent shapes and have the line symmetric shapes along the axial direction X with respect to the center positions in the axial direction X, the relay terminals 31 are not limited to be formed in this manner and the first connection portions 31*a* and the second connection portions 31*b* may have different shapes or asymmetric shapes. Although the relay terminals 31 are formed to have a substantially ω (omega) shape overall, the relay terminals 31 are not limited to having this shape and it is sufficient that the relay terminals 31 include the first connection portions connected to the first counterpart terminals, the second connection portions connected to the second counterpart terminals, and the coupling portions supported on the reaction force receiving portions. The first connection portions and the second connection portions may be configured by, for example, conductive metal coil springs coupled through the coupling portions. The relay terminals 31 may have the configuration in which the indent portions 31*ae* and 31*be* are provided with intervals along the first width direction Y and wiping (removing oxide films) of the first connection surfaces 21*e* and the second connection surfaces 41*d* can be performed by the indent portions 31*ae* and 31*be* with the elastic deformation of the first connection portions and the second connection portions.

Figure 11:
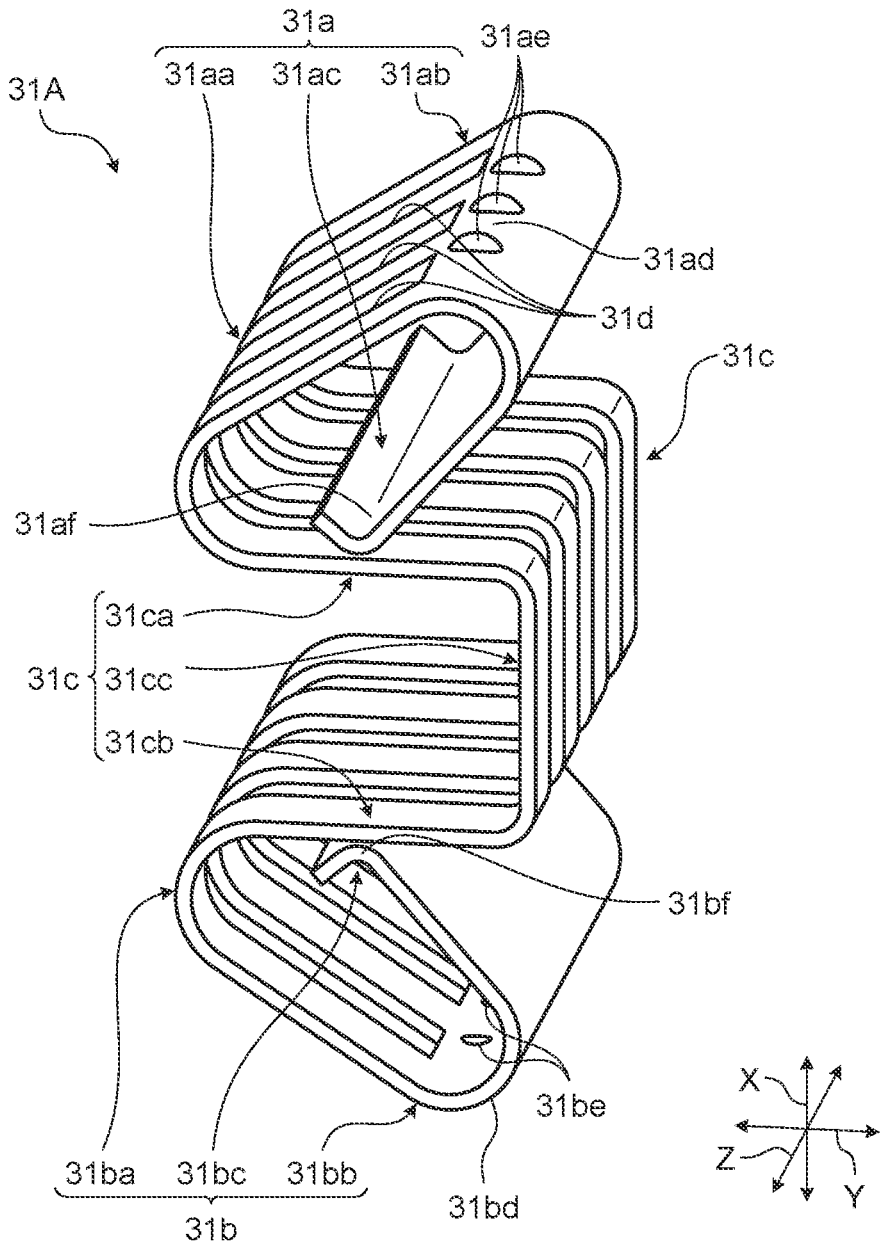
FIG. 11 is a perspective view illustrating the schematic configuration of a relay terminal included in a connection device according to a modification.

For example, each of relay terminals 31A according to a modification, which is illustrated in FIG. 11, may include slits 31*d*. The slits 31*d* are formed across the first connection portions 31*a*, the coupling portions 31*c*, and the second connection portions 31*b*. The slits 31*d* are formed so as to extend to the vicinities of the top portions 31*bd* of the second connection portions 31*b* from the vicinities of the top portions 31*ad* of the first connection portions 31*a*. In this example, three slits 31*d* are formed with intervals along the second width direction Z. With the relay terminals 31A in the modification, formation of the slits 31*d* in the relay terminals 31A can lower rigidity of the sites at which the slits 31*d* are formed than that of other sites in the relay terminals 31A. With this configuration, the sites of the relay terminals 31A at which the slits 31*d* are formed can be made easy to be deformed when the first counterpart terminals 21 and the second counterpart terminals 41 abut against the first connection portions 31*a* and the second connection portions 31*b*, respectively, and the first connection portions 31*a* and the second connection portions 31*b* are pressed along the axial direction X. Accordingly, the relay terminals 31A can absorb tolerances three dimensionally in the axial direction X, the first width direction Y, and the second width direction Z because the sites are elastically deformed while being twisted. As a result, the connection device 1 to which the relay terminals 31A in the modification are applied can stabilize the contact points also in this point.

Figure 12:
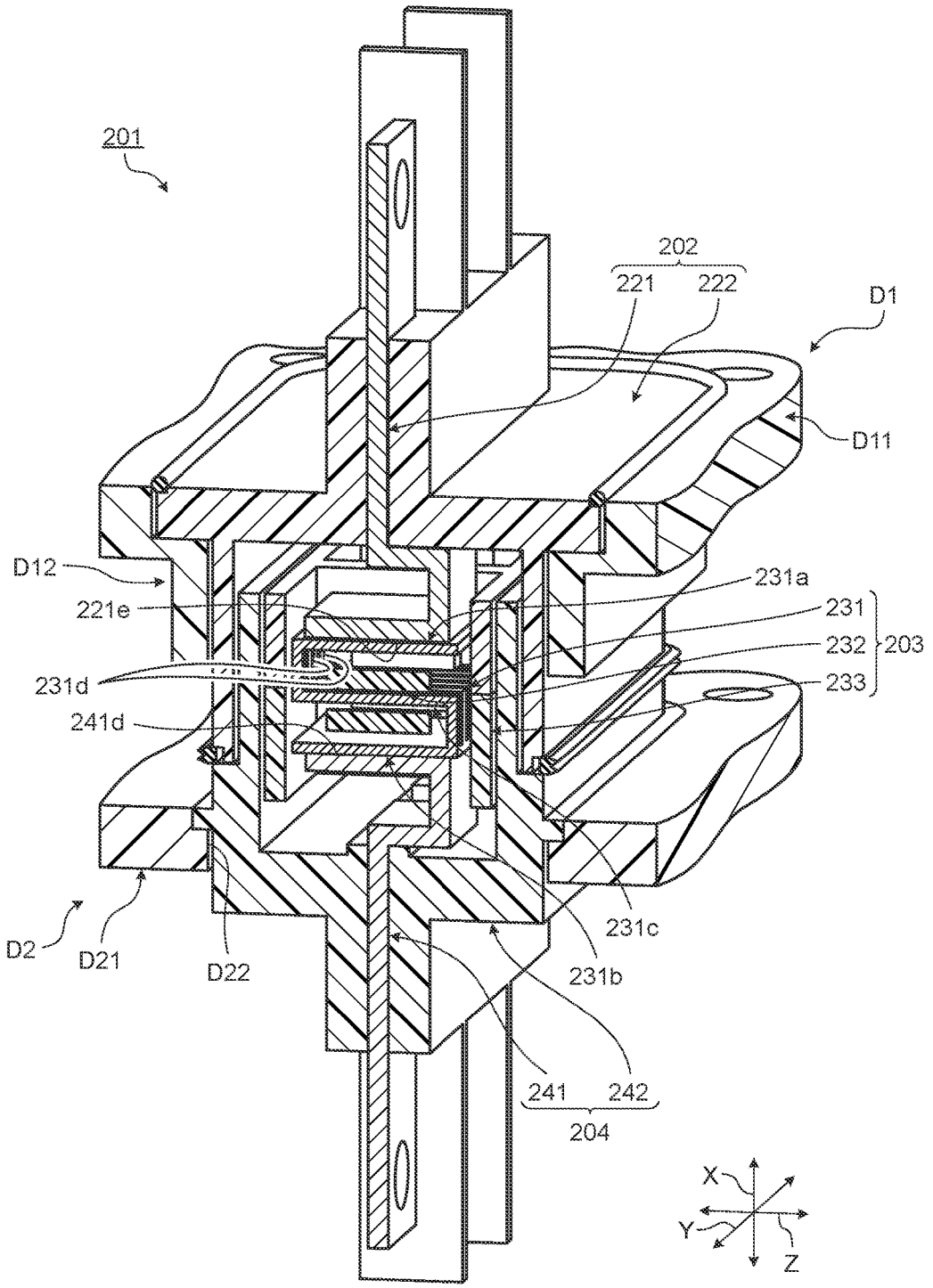
FIG. 12 is a partial cross-sectional perspective view illustrating a connection device according to a reference example.

A connection device 201 according to a reference example illustrated in FIG. 12 is an example in which relay terminals 231 that do not include a reaction force receiving portion and that are formed into substantially Z shapes overall are applied. The connection device 201 in the reference example includes a first connector 202 provided in the first device D1, a relay connector 203 to which the relay terminals 231 are applied, and a second connector 204 provided in the second device D2. The first connector 202 includes first counterpart terminals 221 and a first housing 222, and the first counterpart terminals 221 are provided in the first housing 222 along the axial direction X. The relay connector 203 includes the relay terminals 231, a holding unit 232, and a relay housing 233, and the relay terminals 231 are provided in the holding unit 232 assembled on the relay housing 233. The relay terminals 231 have first connection portions 231*a*, second connection portions 231*b*, and coupling portions 231*c* connecting the first connection portions 231*a* and the second connection portions 231*b*. The second connector 204 includes second counterpart terminals 241 and a second housing 242, and the second counterpart terminals 241 are provided in the second housing 242 along the axial direction X. In the connection device 201, first connection surfaces 221*e* of the first counterpart terminals 221 are connected to the first connection portions 231*a* of the relay terminals 231 and second connection surfaces 241*d* of the second counterpart terminals 241 are connected to the second connection portions 231*b* of the relay terminals 231. The relay terminals 231 have a plurality of slits 231*d* that are formed across the first connection portions 231*a*, the coupling portions 231*c*, and the second connection portions 231*b* in the same manner as the relay terminals 31A. In this case, the connection device 201 in the reference example can make sites at which the slits 231*d* of the relay terminals 231 are formed easy to be deformed and can absorb tolerances three dimensionally in the axial direction X, the first width direction Y, and the second width direction Z because the sites are elastically deformed while being twisted, thereby stabilizing contact points.

A connection device and a relay connector according to the present embodiment can electrically connect a first counterpart terminal and a second counterpart terminal through a first connection portion, a coupling portion, and a second connection portion of a relay terminal. In this case, the relay terminal is held in a holding unit in a state in which the coupling portion connecting the first connection portion and the second connection portion is supported on a reaction force receiving portion, and the reaction force receiving portion receives reaction force with elastic deformation of the first connection portion and reaction force with elastic deformation of the second connection portion. With this configuration, the connection device and the relay connector enable the first connection portion and the second connection portion to be elastically deformed independently, thereby properly ensuring a contact pressure (contact load) at a contact point between the first connection portion and the first counterpart terminal and a contact pressure at a contact point between the second connection portion and the second counterpart terminal independently. With this configuration, the connection device and the relay connector provide an effect of stabilizing the contact points.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connection device comprising:

a conductive first counterpart terminal;

a conductive second counterpart terminal that is different from the first counterpart terminal;

a conductive relay terminal that includes a first connection portion capable of being elastically deformed along a first direction, a second connection portion capable of being elastically deformed along the first direction, and a coupling portion interposed between the first connection portion and the second connection portion along the first direction and connecting the first connection portion and the second connection portion, and that is formed integrally with the first connection portion, the second connection portion, and the coupling portion; and a holding unit that holds the relay terminal and includes a reaction force receiving portion supporting the coupling portion with such positional relation that the first counterpart terminal is capable of being connected to the first connection portion from one side in the first direction and the second counterpart terminal is capable of being connected to the second connection portion from another side in the first direction, and receiving reaction force with elastic deformation of the first connection portion and reaction force with elastic deformation of the second connection portion.

2. The connection device according to claim 1, wherein the first connection portion has a first base end portion continuous to the coupling portion, a first elastic bending portion formed so as to be continuous to the first base end portion at one side in the first direction while being bent and capable of abutting against the first counterpart terminal, and a first front end portion continuous to the first elastic bending portion at an opposite side to the first base end portion and supporting the first elastic bending portion on the coupling portion, and the second connection portion has a second base end portion continuous to the coupling portion, a second elastic bending portion formed so as to be continuous to the second base end portion at another side in the first direction while being bent and capable of abutting against the second counterpart terminal, and a second front end portion continuous to the second elastic bending portion at an opposite side to the second base end portion and supporting the second elastic bending portion on the coupling portion.

3. The connection device according to claim 1, wherein the coupling portion has a first base portion to which the first connection portion is connected, a second base portion that opposes the first base portion with the reaction force receiving portion interposed therebetween in the first direction and to which the second connection portion is connected, and a connecting portion that connects the first base portion and the second base portion along the first direction.

4. The connection device according to claim 2, wherein the coupling portion has a first base portion to which the first connection portion is connected, a second base portion that opposes the first base portion with the reaction force receiving portion interposed therebetween in the first direction and to which the second connection portion is connected, and a connecting portion that connects the first base portion and the second base portion along the first direction.

5. The connection device according to claim 1, further comprising:

a relay housing that includes an accommodation space portion that accommodates, in an inner portion formed into a hollow shape, the holding unit holding the relay terminal so as to make the holding unit relatively movable in the first direction, a first insertion hole that is opened to one side in the first direction and communicates with the accommodation space portion and through which the first counterpart terminal is capable of being inserted along the first direction, and a second insertion hole that is opened to another side in the first direction and communicates with the accommodation space portion and through which the second counterpart terminal is capable of being inserted along the first direction.

6. The connection device according to claim 2, further comprising:

a relay housing that includes an accommodation space portion that accommodates, in an inner portion formed into a hollow shape, the holding unit holding the relay terminal so as to make the holding unit relatively movable in the first direction, a first insertion hole that is opened to one side in the first direction and communicates with the accommodation space portion and through which the first counterpart terminal is capable of being inserted along the first direction, and a second insertion hole that is opened to another side in the first direction and communicates with the accommodation space portion and through which the second counterpart terminal is capable of being inserted along the first direction.

7. The connection device according to claim 3, further comprising:

a relay housing that includes an accommodation space portion that accommodates, in an inner portion formed into a hollow shape, the holding unit holding the relay terminal so as to make the holding unit relatively movable in the first direction, a first insertion hole that is opened to one side in the first direction and communicates with the accommodation space portion and through which the first counterpart terminal is capable of being inserted along the first direction, and a second insertion hole that is opened to another side in the first direction and communicates with the accommodation space portion and through which the second counterpart terminal is capable of being inserted along the first direction.

8. The connection device according to claim 1, wherein the relay terminal has a slit formed across the first connection portion, the coupling portion, and the second connection portion.

9. The connection device according to claim 2, wherein the relay terminal has a slit formed across the first connection portion, the coupling portion, and the second connection portion.

10. The connection device according to claim 3, wherein the relay terminal has a slit formed across the first connection portion, the coupling portion, and the second connection portion.

11. The connection device according to claim 5, wherein the relay terminal has a slit formed across the first connection portion, the coupling portion, and the second connection portion.

12. The connection device according to claim 1, wherein the first counterpart terminal has a first connection surface that is planarly formed along an intersection direction intersecting with the first direction and abuts against the first connection portion, and the second counterpart terminal has a second connection surface that is planarly formed along the intersection direction and abuts against the second connection portion.

13. The connection device according to claim 2, wherein the first counterpart terminal has a first connection surface that is planarly formed along an intersection direction intersecting with the first direction and abuts against the first connection portion, and the second counterpart terminal has a second connection surface that is planarly formed along the intersection direction and abuts against the second connection portion.

14. The connection device according to claim 3, wherein the first counterpart terminal has a first connection surface that is planarly formed along an intersection direction intersecting with the first direction and abuts against the first connection portion, and the second counterpart terminal has a second connection surface that is planarly formed along the intersection direction and abuts against the second connection portion.

15. The connection device according to claim 5, wherein the first counterpart terminal has a first connection surface that is planarly formed along an intersection direction intersecting with the first direction and abuts against the first connection portion, and the second counterpart terminal has a second connection surface that is planarly formed along the intersection direction and abuts against the second connection portion.

16. The connection device according to claim 8, wherein the first counterpart terminal has a first connection surface that is planarly formed along an intersection direction intersecting with the first direction and abuts against the first connection portion, and the second counterpart terminal has a second connection surface that is planarly formed along the intersection direction and abuts against the second connection portion.

17. The connection device according to claim 1, wherein the first counterpart terminal configures a first connector provided in a first device, and the second counterpart terminal configures a second connector provided in a second device that is different from the first device.

18. The connection device according to claim 2, wherein the first counterpart terminal configures a first connector provided in a first device, and the second counterpart terminal configures a second connector provided in a second device that is different from the first device.

19. The connection device according to claim 3, wherein the first counterpart terminal configures a first connector provided in a first device, and the second counterpart terminal configures a second connector provided in a second device that is different from the first device.

20. A relay connector comprising:

a conductive relay terminal that includes a first connection portion capable of being elastically deformed along a first direction, a second connection portion capable of being elastically deformed along the first direction, and a coupling portion interposed between the first connection portion and the second connection portion along the first direction and connecting the first connection portion and the second connection portion, and that is formed integrally with the first connection portion, the second connection portion, and the coupling portion; and a holding unit that holds the relay terminal and includes a reaction force receiving portion supporting the coupling portion with such positional relation that a conductive first counterpart terminal is capable of being connected to the first connection portion from one side in the first direction and a conductive second counterpart terminal different from the first counterpart terminal is capable of being connected to the second connection portion from another side in the first direction, and receiving reaction force with elastic deformation of the first connection portion and reaction force with elastic deformation of the second connection portion, wherein the first connection portion has a first base end portion continuous to the coupling portion, a first elastic bending portion formed so as to be continuous to the first base end portion at one side in the first direction while being bent and capable of abutting against the first counterpart terminal, and a first front end portion continuous to the first elastic bending portion at an opposite side to the first base end portion and supporting the first elastic bending portion on the coupling portion, the second connection portion has a second base end portion continuous to the coupling portion, a second elastic bending portion formed so as to be continuous to the second base end portion at another side in the first direction while being bent and capable of abutting against the second counterpart terminal, and a second front end portion continuous to the second elastic bending portion at an opposite side to the second base end portion and supporting the second elastic bending portion on the coupling portion, the first front end portion is formed to be continuous from the first elastic bending portion to fold back toward the coupling portion so as to abut on the coupling portion, and the second front end portion is formed to be continuous from the second elastic bending portion to fold back toward the coupling portion so as to abut on the coupling portion.

* * * * *